US006497206B2

(12) United States Patent
Nohara et al.

(10) Patent No.: US 6,497,206 B2
(45) Date of Patent: Dec. 24, 2002

(54) ENGINE WITH TWO CYLINDER BANKS EACH WITH A VALVE OPERATING DEVICE ENABLING VARIATION OF VALVE TIMING AND VALVE LIFT CHARACTERISTIC

(75) Inventors: Tsuneyasu Nohara, Kanagawa (JP); Yoshihiko Yamada, Kanagawa (JP); Makoto Nakamura, Kanagawa (JP)

(73) Assignees: Nissan Motor Co., Ltd., Yokohama (JP); Unisia Jecs Corporation, Atsugi (JP)

( * ) Notice: Subject to any disclaimer, the term of this patent is extended or adjusted under 35 U.S.C. 154(b) by 102 days.

(21) Appl. No.: 09/796,728

(22) Filed: Mar. 2, 2001

(65) Prior Publication Data

US 2002/0023601 A1 Feb. 28, 2002

(30) Foreign Application Priority Data

Aug. 22, 2000 (JP) ..... 2000-250838

(51) Int. Cl.[7] ..... F01L 13/00

(52) U.S. Cl. ..... 123/90.16; 123/90.17; 123/54.4

(58) Field of Search ..... 123/90.15, 90.16, 123/90.17, 54.4–54.8

(56) References Cited

U.S. PATENT DOCUMENTS 5,423,295 A * 6/1995 Murata et al. ..... 123/90.16
5,429,079 A * 7/1995 Murata et al. ..... 123/90.16
5,988,125 A * 11/1999 Hara et al. ..... 123/90.16
6,019,076 A * 2/2000 Pierik et al. ..... 123/90.16
6,123,053 A * 9/2000 Hara et al. ..... 123/90.16
6,260,523 B1 * 7/2001 Nakamura et al. ..... 123/90.15
6,311,659 B1 * 11/2001 Pierik ..... 123/90.24

FOREIGN PATENT DOCUMENTS

JP 55-137305 10/1980

* cited by examiner

*Primary Examiner*—Weilun Lo
(74) *Attorney, Agent, or Firm*—Foley & Lardner

(57) ABSTRACT

In an internal combustion engine with two cylinder banks, each cylinder bank having a cylinder head mounting thereon a valve operating device enabling both valve timing and valve lift characteristic to be varied, each valve operating device drives an engine valve through an eccentric cam, a substantially ring-shaped link, a rocker arm, a rod-shaped link, and a rockable cam, by rotation of a drive shaft. A control shaft varies the attitude of the rocker arm via a control cam by rotary motion thereof, in order to change a valve lift characteristic of the engine valve. As viewed in the same axial direction, a lifting direction of the rockable cam relative to a rotational direction of the drive shaft is the same in the two cylinder banks.

33 Claims, 12 Drawing Sheets

ENGINE WITH TWO CYLINDER BANKS EACH WITH A VALVE OPERATING DEVICE ENABLING VARIATION OF VALVE TIMING AND VALVE LIFT CHARACTERISTIC

TECHNICAL FIELD

The present invention relates to an internal combustion engine with two cylinder banks each having a valve operating device enabling valve timing and valve lift characteristic to be varied, and in particular being capable of changing both valve timing and valve lift characteristic (working angle and valve lift) of intake and/or exhaust valves depending on engine operating conditions, and specifically to a variable valve timing and variable valve lift characteristic device applicable to a two-bank engine in which a cylinder head and intake and exhaust valves arranged in one cylinder bank and a cylinder head and intake and exhaust valves arranged in the other cylinder bank are substantially mirror-symmetrical with respect to a centerline of the two cylinder banks.

BACKGROUND ART

In recent years, there have been proposed and developed various types of variable valve timing and valve lift characteristic mechanism which variably adjust both valve timing and valve lift characteristic (working angle and valve lift) of intake and/or exhaust valves, for the purpose of improved fuel economy (low fuel consumption) and enhanced stability (stable engine operations) at low-speed light-load operation, and sufficient engine power output resulting from the enhanced charging efficiency of intake air at high-speed heavy-load operation. One such variable valve timing and variable valve lift characteristic mechanism or device has been disclosed in Japanese Patent Provisional Publication No. 55-137305 (hereinafter is referred to as JP55-137305). The variable valve timing and variable valve lift characteristic mechanism or device as disclosed in JP55-137305, includes a drive shaft rotating in synchronism with rotation of an engine crankshaft, a camshaft having cams and fitted on the outer periphery of the drive shaft to be relatively rotatable about the drive shaft, a rockable cam provided on the outer periphery of a support shaft for driving intake and exhaust valves, an eccentric cam provided eccentrically on a control shaft, and a rocker arm rotatably fitted onto the outer periphery of the eccentric cam for mechanically linking the associated cam with the rockable cam therethrough. Rotating the control shaft varies the center of oscillating motion of the rocker arm, thereby varying a valve lift characteristic of intake and/or exhaust valves.

SUMMARY OF THE INVENTION

Assuming that the variable valve timing and variable valve lift characteristic mechanism or device as disclosed in JP55-137305 is applied simply to each of two cylinder banks of a V-type engine without full deliberation upon the layout of the variable valve timing and variable valve lift characteristic mechanism or device with regard to a direction of rotation of each of the drive shafts, there is a possibility that valve lift characteristics of left and right banks differ from each other.

Accordingly, it is an object of the invention to provide an internal combustion engine with two cylinder banks each having a valve operating device enabling variations of valve timing and valve lift characteristic (working angle and valve lift), which avoids the aforementioned disadvantages.

It is another object of the invention to provide a valve operating device for an internal combustion engine with two cylinder banks each having a variable valve timing and variable valve lift characteristic mechanism in which a valve lift characteristic of a first bank of the two cylinder banks is essentially equivalent to that of the second bank during variable valve-lift control.

In order to accomplish the aforementioned and other objects of the present invention, an internal combustion engine with a crankshaft and two cylinder banks, each cylinder bank having a cylinder head and a valve operating device enabling both valve timing and valve lift characteristic to be varied, each valve operating device comprises a drive shaft installed in the cylinder head of each cylinder bank and rotating in synchronism with rotation of the crankshaft, the drive shaft having a center and an axis of rotation, an eccentric cam fixedly connected to the drive shaft so that a center of the eccentric cam is eccentric with respect to the center of the drive shaft, a rockable cam arranged to drive at least one engine valve, a power-transmission mechanism mechanically linking the eccentric cam to the rockable cam, a control mechanism provided for varying an attitude of the power-transmission mechanism, and as viewed in the same axial direction, a lifting direction of the rockable cam arranged in a first one of the two cylinder banks relative to a rotational direction of the drive shaft arranged in the first cylinder bank, and a lifting direction of the rockable cam arranged in the second cylinder bank relative to a rotational direction of the drive shaft arranged in the second cylinder bank are set to be identical to each other.

According to another aspect of the invention, an internal combustion engine with a crankshaft and two cylinder banks, each cylinder bank having a cylinder head and a valve operating device enabling both valve timing and valve lift characteristic to be varied, each valve operating device comprises a drive shaft installed in the cylinder head of each cylinder bank and rotating in synchronism with rotation of the crankshaft, the drive shaft having a center and an axis of rotation, a control shaft extending substantially parallel to the drive shaft and rotated toward and held at an angular position based on engine operating conditions, a rockable cam fitted to an outer periphery of the drive shaft so as to be relatively rotatable about the drive shaft and to drive at least one engine valve, an eccentric cam fixedly connected to the drive shaft so that a center of the eccentric cam is eccentric with respect to the center of the drive shaft, a first link member fitted to an outer periphery of the eccentric cam so as to be relatively rotatable about the eccentric cam, a control cam fixedly connected to the control shaft so that a center of the control cam is eccentric with respect to a center of the control shaft, a rocker arm whose one end is linked to a tip end of the first link member so as to be rotatable relative to the first link member, the rocker arm being fitted to an outer periphery of the control cam so as to be relatively rotatable about the control cam, a second link member linked to both the other end of the rocker arm and the rockable cam so as to be rotatable relative to both the rocker arm and the rockable cam, as viewed in the same axial direction and when using a valve stem axis of the engine valve as a reference, the valve operating device arranged in the first cylinder bank and the valve operating device arranged in the second cylinder bank are laid out substantially similarly to each other, and the rotational direction of the drive shaft arranged in the first cylinder bank and the rotational direction of the drive shaft arranged in the second cylinder bank are set to be identical to each other.

According to a further aspect of the invention, a valve operating device for a V-type internal combustion engine equipped with a crankshaft and left and right cylinder banks, each cylinder bank having a cylinder head and a variable valve timing and variable valve lift characteristic mechanism, comprises a drive shaft installed in the cylinder head of each cylinder bank and rotating in synchronism with rotation of the crankshaft, the drive shaft having a center and an axis of rotation, an eccentric cam fixedly connected to the drive shaft so that a center of the eccentric cam is eccentric with respect to the center of the drive shaft, a rockable cam arranged to drive at least one engine valve, a power-transmission mechanism mechanically linking the eccentric cam to the rockable cam, a control mechanism provided for varying an attitude of the power-transmission mechanism, and as viewed in the same axial direction, a lifting direction of the rockable cam arranged in a first one of the left and right cylinder banks relative to a rotational direction of the drive shaft arranged in the first cylinder bank, and a lifting direction of the rockable cam arranged in the second cylinder bank relative to a rotational direction of the drive shaft arranged in the second cylinder bank are set to be identical to each other, the lifting direction being defined as a direction of oscillating motion of the rockable cam from a position that the engine valve begins to lift to a position that the engine valve reaches a maximum valve-lift state in which a magnitude of valve lift of the engine valve is a maximum value.

According to a still further aspect of the invention, a valve operating device for a V-type internal combustion engine equipped with a crankshaft and two cylinder banks, each cylinder bank having a cylinder head and a variable valve timing and variable valve lift characteristic mechanism, comprises a drive shaft installed in the cylinder head of each cylinder bank and rotating in synchronism with rotation of the crankshaft, the drive shaft having a center and an axis of rotation, a control shaft extending substantially parallel to the drive shaft and rotated toward and held at an angular position based on engine operating conditions, a rockable cam fitted to an outer periphery of the drive shaft so as to be relatively rotatable about the drive shaft and to drive at least one intake valve, an eccentric cam fixedly connected to the drive shaft so that a center of the eccentric cam is eccentric with respect to the center of the drive shaft, a first link member fitted to an outer periphery of the eccentric cam so as to be relatively rotatable about the eccentric cam, a control cam fixedly connected to the control shaft so that a center of the control cam is eccentric with respect to a center of the control shaft, a rocker arm whose one end is linked to a tip end of the first link member so as to be rotatable relative to the first link member, the rocker arm being fitted to an outer periphery of the control cam so as to be relatively rotatable about the control cam, a second link member linked to both the other end of the rocker arm and the rockable cam so as to be rotatable relative to both the rocker arm and the rockable cam, as viewed in the same axial direction and when using a valve stem axis of the intake valve as a reference, the valve operating device arranged in the first cylinder bank and the valve operating device arranged in the second cylinder bank are laid out substantially congruently with each other, and the rotational direction of the drive shaft arranged in the first cylinder bank and the rotational direction of the drive shaft arranged in the second cylinder bank are set to be identical to each other.

The other objects and features of this invention will become understood from the following description with reference to the accompanying drawings.

DESCRIPTION OF THE PREFERRED EMBODIMENTS

Figure 1:
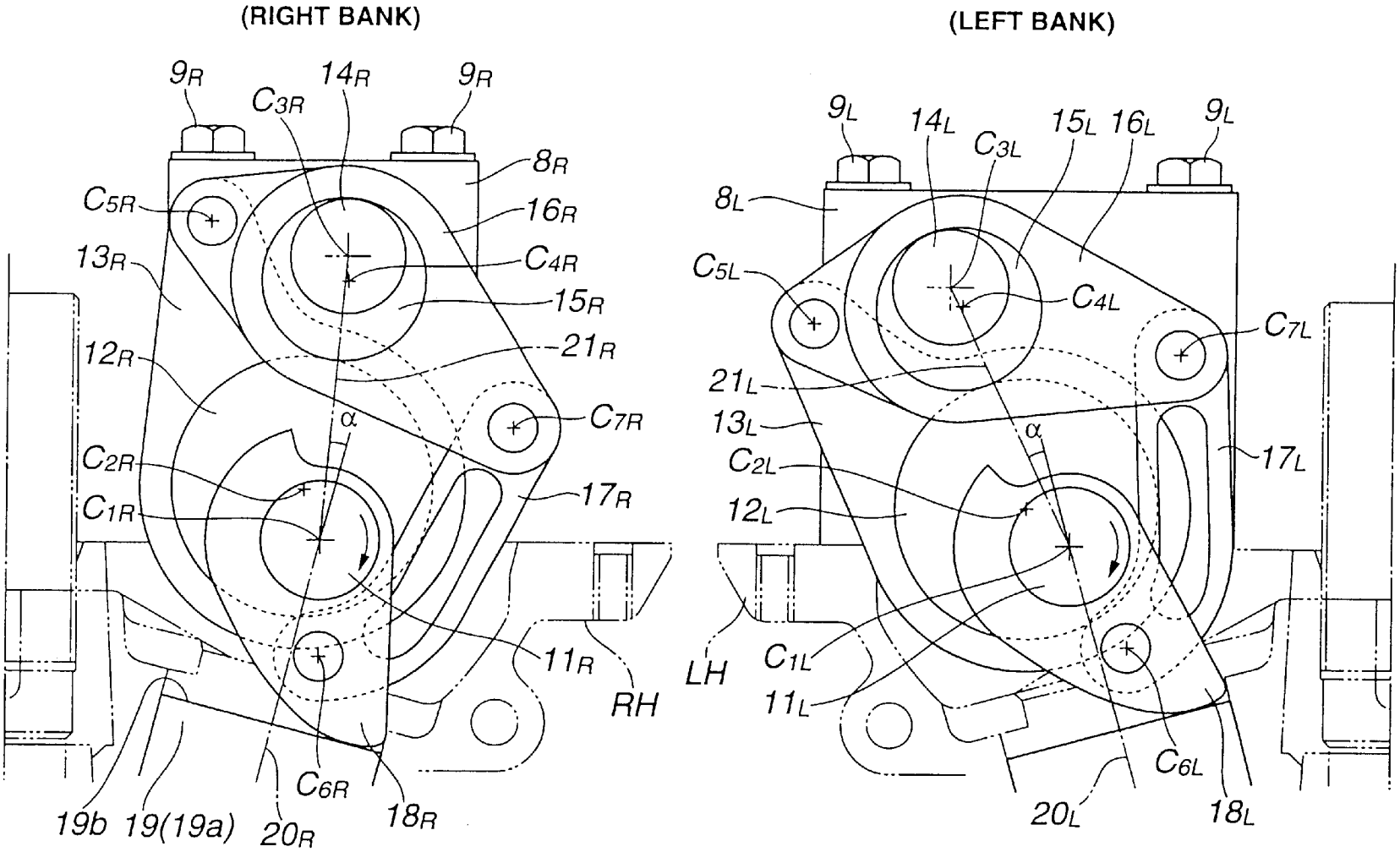
FIG. 1 is a front enlarged view illustrating the essential part of a valve operating device of a first embodiment.
Figure 2:
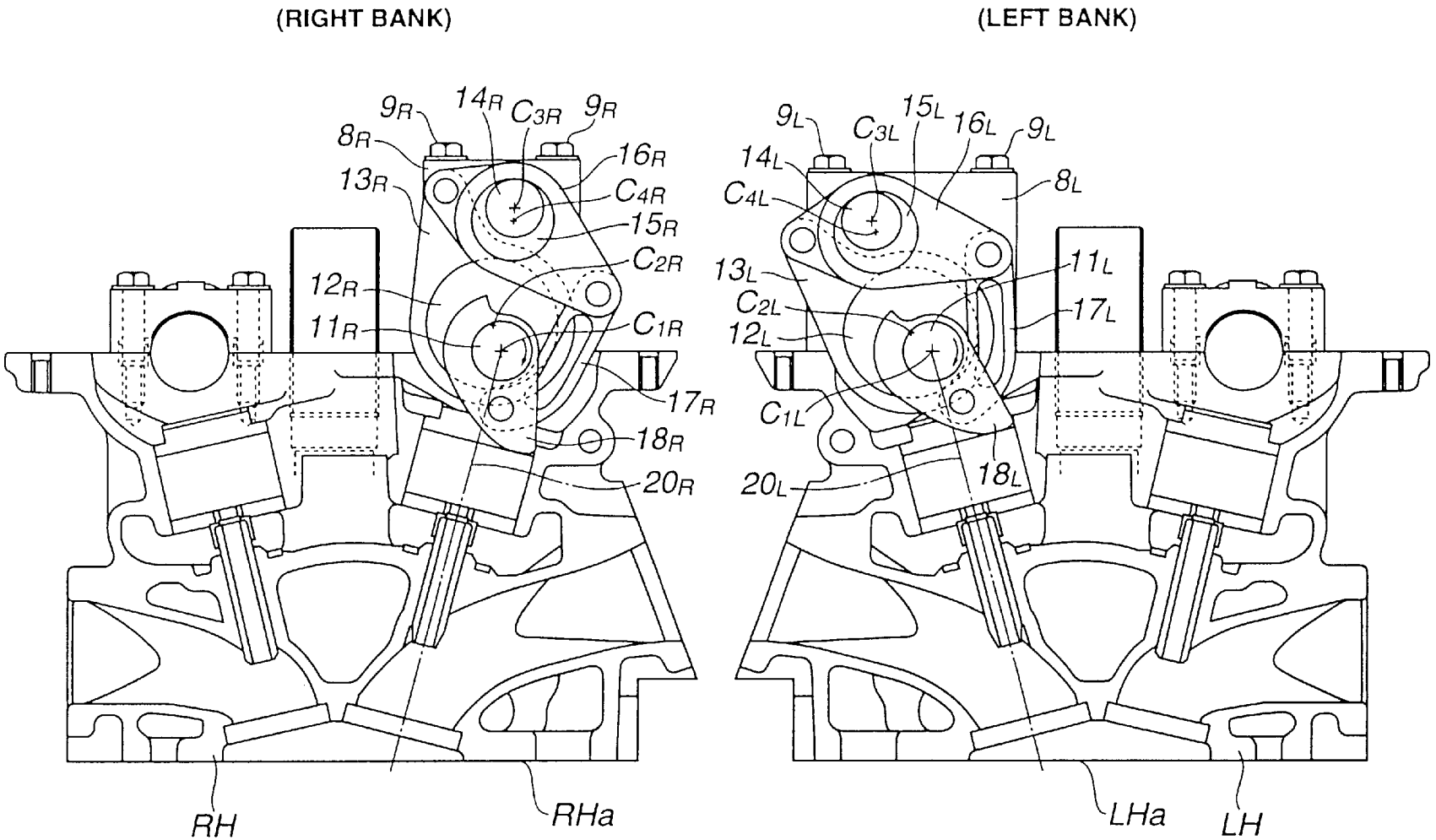
FIG. 2 is a lateral cross-sectional view illustrating left-bank and right-bank cylinder heads of a two-bank internal combustion engine equipped with the valve operating device with a variable valve timing and valve lift characteristic mechanism of the first embodiment shown in FIG. 1.
Figure 3:
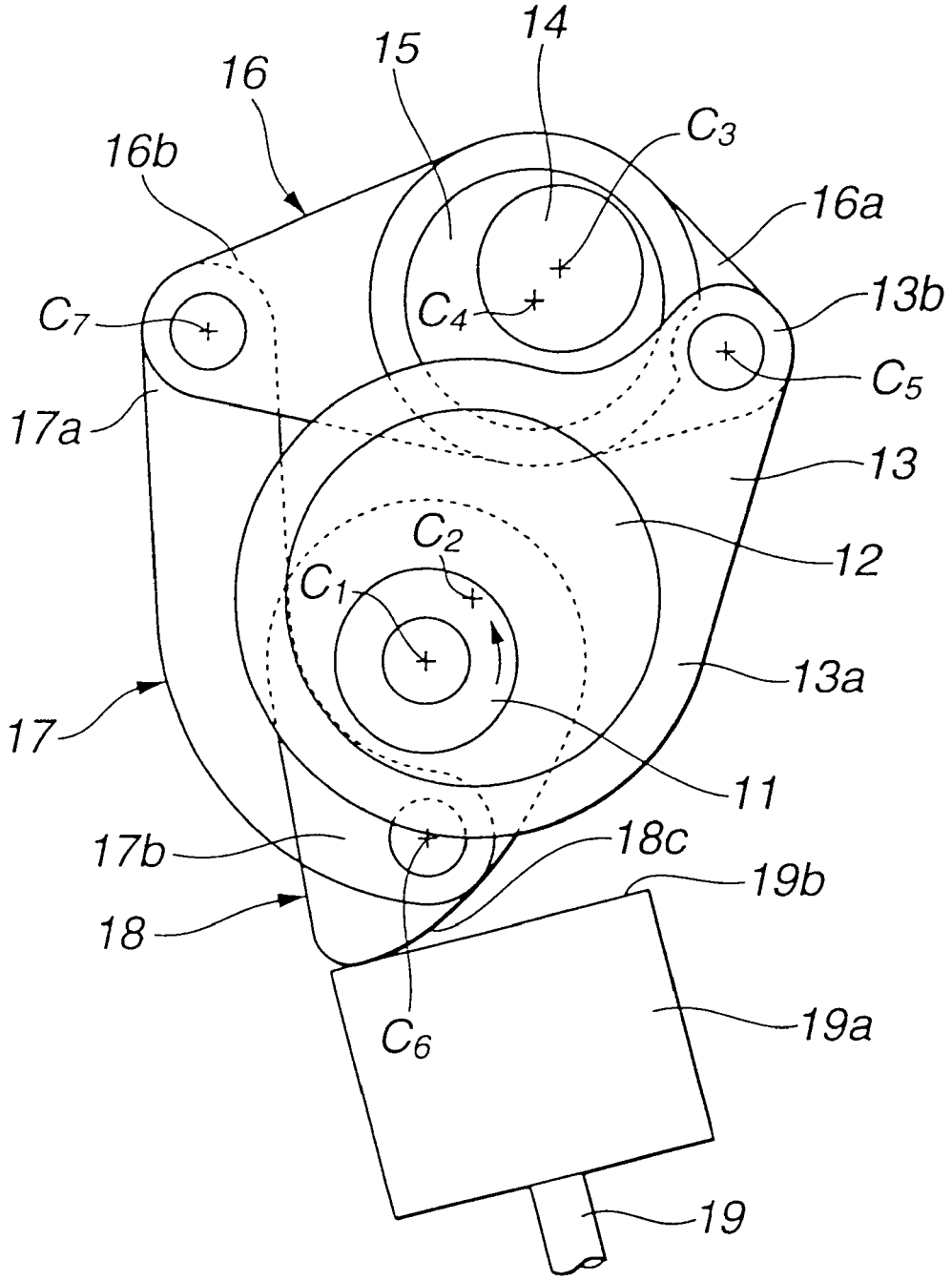
FIG. 3 is a rear view illustrating details of the valve operating device of the first embodiment applied to the two-bank engine.

Referring now to the drawings, particularly to FIGS. 1 and 2, the valve operating device of the first embodiment is exemplified as a valve operating device with a variable valve timing and valve lift characteristic mechanism for intake valves employed in a V-type double-overhead-camshaft (DOHC) combustion engine equipped with left and right cylinder banks. As seen in FIG. 1, the V-type engine has a cylinder head RH arranged in a right bank and a cylinder head LH arranged in a left bank. In FIGS. 1 and 2, although a cylinder-block mounting surface RHa of right-bank cylinder head RH and a cylinder-block mounting surface LHa of left-bank cylinder head LH are illustrated in the same plane, actually these mounting surfaces RHa and LHa are inclined to each other at a predetermined bank angle. A pair of valve operating devices are located at the respective left and right cylinder banks. Basically, the left-bank valve operating device and the right-bank valve operating device are symmetrically arranged each other. For the purpose of simplification of the disclosure, the same reference signs used to designate elements shown in the left bank will be applied to the corresponding elements shown in the right bank, and also, in case of necessity for discrimination between left and right banks, the character "L" is added to indicate component parts arranged in the left bank whereas the character "R" is added to indicate component parts arranged in the right bank. As best seen in FIG. 2, intake valves are toward the inside of the two banks, whereas exhaust valves are toward the outside of the two banks. An exhaust camshaft (not numbered) is provided for opening and closing exhaust valves arranged in each of the two banks. One drive shaft 11 is arranged above the intake valves and located parallel to the exhaust camshaft over a plurality of engine cylinders. The drive shaft 11 has a center C1 and an axis of rotation. The exhaust camshaft has a camshaft sprocket (not shown) at its front end, and has a driven connection with the engine crankshaft via a crankshaft sprocket (not shown). Drive shaft 11, arranged in each of the two banks, has a camshaft sprocket (not shown) at its front end, and has a driven connection with the crankshaft, so that the drive shaft rotates together with the exhaust camshaft via a timing chain (not shown) during rotation of the crankshaft. That is to say, the crankshaft sprocket drives the timing chain, and then the timing chain drives all of the exhaust camshafts and the drive shafts arranged in the two banks. Generally, in V-type engines, the timing belt and sprocket arrangement is symmetric. Thus, a pair of drive shafts 11 of the left and right banks rotate in the same rotational direction (as can be seen from the two clockwise arrows shown in FIGS. 1 or 2). Details of the valve operating device of the first embodiment are shown in FIG. 3. The variable valve timing and valve lift characteristic mechanism of the valve operating device of the embodiment is provided for every engine cylinders of each bank.

The detailed structure of the variable valve timing and valve lift characteristic mechanism of the valve operating device of the first embodiment is hereunder described in reference to FIG. 3. Note that FIG. 3 shows the view from the rear end of the variable valve timing and valve lift characteristic mechanism, whereas FIGS. 1 and 2 show the lateral cross-sectional view from the front end. Therefore, in FIGS. 3 through 5, drive shaft 11 rotates in the counter-clockwise direction.

As shown in FIG. 3, a substantially cylindrical eccentric cam 12 is fixedly connected onto the outer periphery of drive shaft 11 by way of press-fitting, so that eccentric cam 12 rotates together with drive shaft 11. The center C2 of eccentric cam 12 and the center C1 of drive shaft 11 are eccentric to each other by a predetermined distance. A comparatively large-diameter, main portion 13*a* of a substantially ring-shaped link (a first link member) 13 is fitted onto the outer periphery of eccentric cam 12, so that first link member 13 is rotatable relative to eccentric cam 12. A so-called control shaft 14 is off to the upper right of drive shaft 11, such that control shaft 14 is located parallel to drive shaft 11 over all of engine cylinders. Control shaft 14 is driven within a predetermined angular range by means of an actuator (not shown) such as a motor, a hydraulic actuator, or the like. Control shaft 14 is rotated toward and held at a desired angular position based on engine operating conditions such as engine speed and engine load. An eccentric ring-shaped control cam 15 is fixedly connected to the outer periphery of control shaft 14 by press-fitting, so that control cam 15 rotates together with control shaft 14. The center C4 of control cam 15 and the center C3 of control shaft 14 are eccentric to each other by a predetermined distance. A central main portion of a rocker arm 16 is fitted onto the outer periphery of control cam 15, so that rocker arm 16 is rotatable relative to control cam 15. One end 16*a* of rocker arm 16 and a tip portion 13*b* of first link member 13 are rotatably connected to each other by means of a connecting pin (or a connecting portion or a connecting pin center C5). The other end 16*b* of rocker arm 16 and a rockable cam 18 are mechanically linked to each other through a rod-shaped link (a second link member) 17 extending in the vertical direction (viewing FIG. 3). One end 17*a* of second link member 17 and the other end 16*b* of rocker arm 16 are rotatably connected to each other by means of a connecting pin (or a connecting portion or a connecting pin center C7). The other end 17*b* of second link member 17 and the tip portion of rockable cam 18 are rotatably connected to each other by means of a connecting pin (or a connecting portion or a connecting pin center C6). A journal portion of drive shaft 11 and a journal portion of control shaft 14 are rotatably supported on the cylinder head (RH, LH) by means of a journal bearing bracket 8 and mounting bolts 9.

With the previously-noted arrangement, when drive shaft 11 rotates in synchronism with rotation of the engine crankshaft, rotational motion of the center C2 of eccentric cam 12 with respect to the center C1 of drive shaft 11 results in a displacement of first link member 13. Responsively to the displacement of first link member 13, rocker arm 16 oscillates or rocks about the center C4 of control cam 15. That is, the center C4 of control cam 15 serves as a center of oscillating motion of rocker arm 16. In the same manner, rockable cam 18 oscillates or rocks through second link member 17. At this time, the cam surface 18*c* of rockable cam 18 is in sliding-contact with the upper surface 19*b* of a valve lifter 19*a* which is located on the upper end (valve stem end) of intake valve 19 and serves as a force-transmission member, and thus the intake valve is able to close and open in synchronism with rotation of the engine crankshaft by moving up and down the valve lifter by the aid of and against the bias of a valve spring (not shown). That is to say, first link member 13, rocker arm 16, and second link member 17 cooperate with each other to construct a power-transmission mechanism via which eccentric cam 12 and rockable cam 18 are mechanically linked to each other.

On the other hand, when control shaft 14 is rotated or driven toward a desired angular position based on the engine operating conditions, the center C4 of control cam 15, i.e., the center C4 of oscillating motion of rocker arm 16, rotates relative to the center C3 of control shaft 14. As a result, the valve lift characteristic of intake valve 19 varies continuously. Concretely, the valve lift and working angle of intake valve 19 tend to increase, as the distance between the center C4 of rocker arm 16 and the center C1 of drive shaft 11 decreases or shortens. Conversely, the valve lift and working angle of intake valve 19 tend to decrease, as the distance between the center C4 of rocker arm 16 and the center C1 of drive shaft 11 increases or lengthens. That is to say, the control shaft 14 and control cam 15 cooperate with each other to construct a control mechanism capable of varying the attitude of the previously-noted power-transmission mechanism.

As discussed above, the valve operating device of the first embodiment of FIGS. 1–3 is constructed in such a manner that rockable cam 18 having a driving connection with the intake valve is fitted onto the outer periphery of drive shaft 11 rotating in synchronism with rotation of the engine crankshaft to permit relative rotation of rockable cam 18 to drive shaft 11. There is no deviation of the center of rotation of rockable cam 18 from the center of rotation of drive shaft 11, thus enhancing the control accuracy of the variable valve timing and valve lift characteristic mechanism. The drive shaft also serves as a support shaft for rockable cam 18. This contributes to reduced component parts and efficient use of a limited installation space. Additionally, three links, namely first link member 13, rocker arm 16, and second link member 17, are linked to each other by way of pin-connection (that is, connecting pin portions C5, C6, and C7), in other words, wall contact between the respective link member and pin. Such a connecting structure (pin-connection) is superior in wear and abrasion resistance and lubricity. As viewed from one axial direction of drive shaft 11, as shown in FIGS. 1 and 2, component parts (12, 13, 15–18) of the variable valve timing and valve lift characteristic mechanism of the valve operating device contained in the left cylinder bank and component parts (12, 13, 15 through 18) of the variable valve timing and valve lift characteristic mechanism of the valve operating device contained in the right cylinder bank are arranged or laid out substantially similarly to each other or substantially congruently with each other. On the other hand, the left-bank cylinder head and left-bank intake and exhaust valves and the right-bank cylinder head and right-bank intake and exhaust valves are substantially mirror-symmetrical with respect to a plane which is mid-way between the axes of the two drive shafts and which is perpendicular to a plane containing the axes. When using the axis of the valve stem of intake valve 19 as a reference, the left-bank valve operating device and the right-bank valve operating device are arranged in the same direction. Moreover, in both of the left and right banks, the straight line 21 passing through the center C1 of drive shaft 11 and the center C3 of control shaft 14 (or line segment 21 between and including drive-shaft center C1 and control-shaft center C3) is set to a predetermined position that the left-bank straight line 21L and the right-bank straight line 21R are rotated about the respective drive shafts 11L and 11R in the same direction (in the same counterclockwise direction opposite to the rotational direction of drive haft 11) by the predetermined same angle $\alpha$ with respect to the valve stem axis 20 (see FIG. 1). That is, a relative phase of left-bank control shaft 14L to drive shaft 11L is set to be identical to a relative phase of right-bank control shaft 14R to drive shaft 11R. The center C1 of drive shaft 11 is located on the valve stem axis 20.

Figure 4:
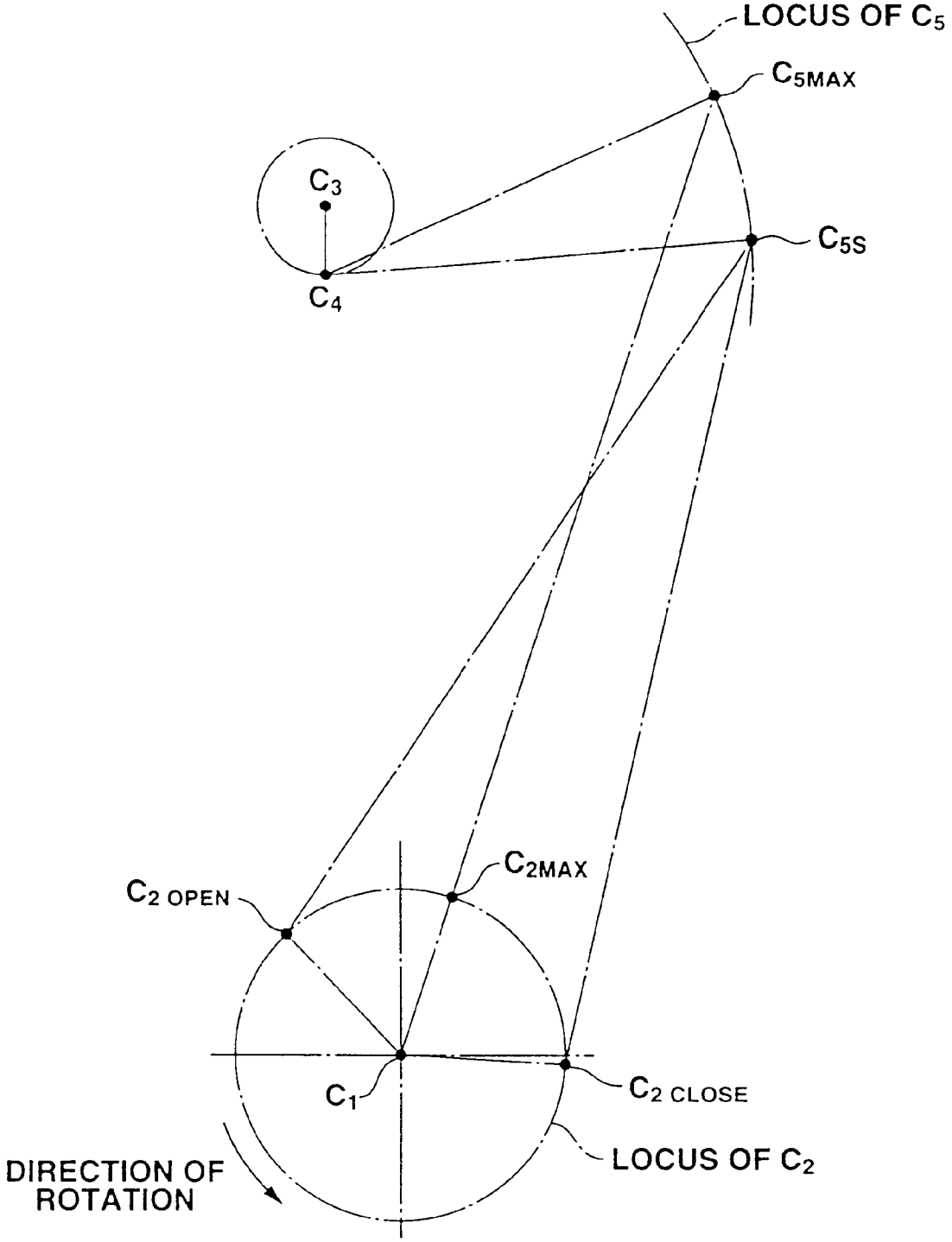
FIGS. 4 and 5 are explanatory views showing dimensions of the valve operating device shown in FIG. 3.
Figure 5:
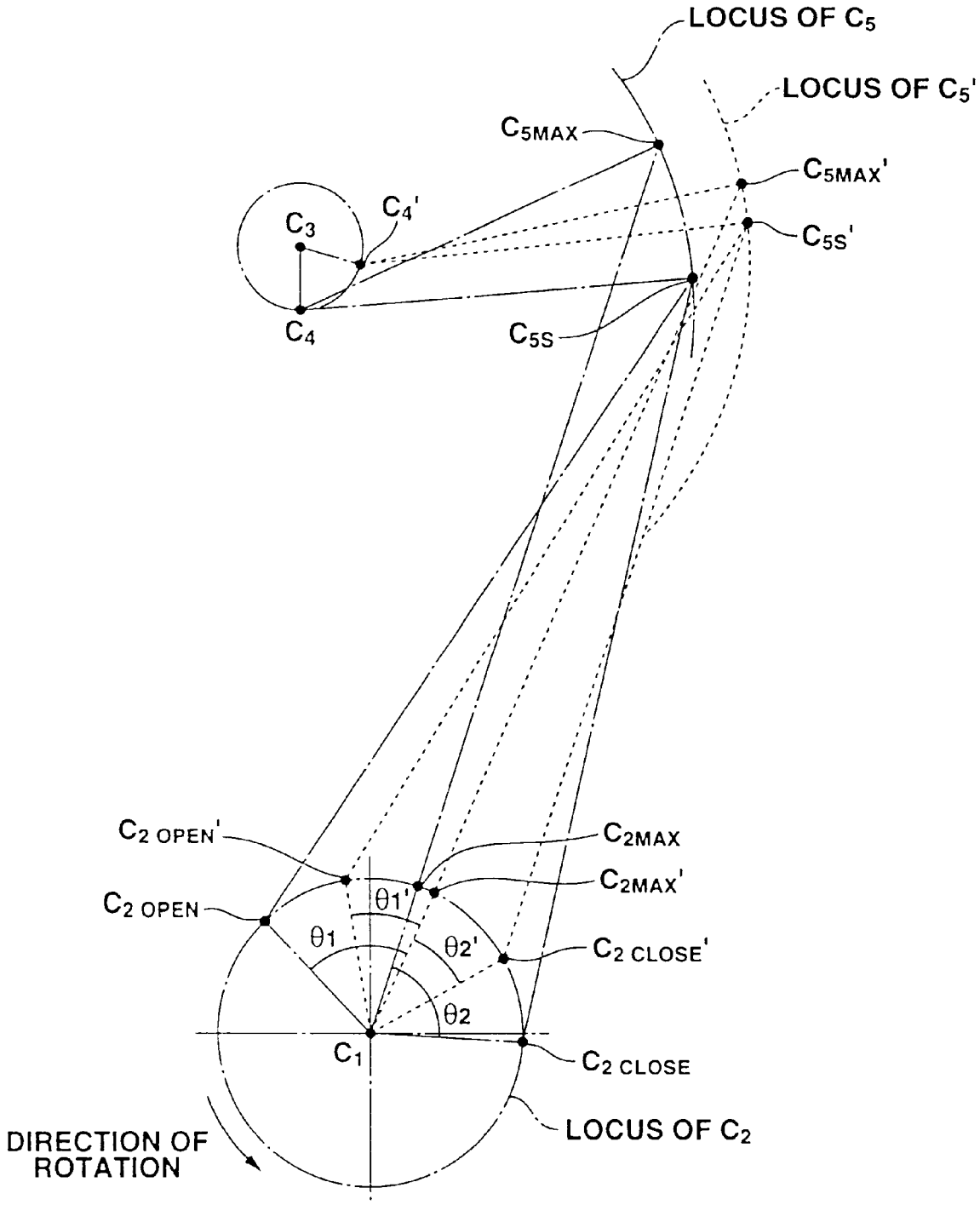

Referring now to FIGS. 4 and 5, there are shown the dimensions of the valve operating device shown in FIG. 3 and the locuses of the center C2 of eccentric cam 12 and the connecting pin center C5.

As shown in FIG. 4, in synchronism with rotation of the engine, the center C2 of eccentric cam 12 moves along the circle with a center which is identical to the center C1 of drive shaft 11. On the other hand, the length of the arm of rocker arm 16 (corresponding to the eccentric distance between the center C4 of control cam 15 and the center C3 of control shaft 14), and the length of the arm of first link member 13 (corresponding to the length between the center C2 of eccentric cam 12 and the connecting pin center C5) are fixed values. Under a condition in which the center C4 of oscillating motion of rocker arm 16 is kept at the position indicated by C4 in FIG. 4, in synchronism with rotation of drive shaft 11, the center C2 of eccentric cam 12 is movable within a specified range from the position indicated by C2OPEN to the position indicated by C2CLOSE, while the connecting pin center C5 is movable within a specified range from the position indicated by C5MAX to the position indicated by C5S. Under such a condition, when the three points of application of force, namely the first applied-force point C1, the second applied-force point C2, and the third applied-force point C5, are aligned with each other, that is, the center C2 of eccentric cam 12 is held at the position C2MAX and additionally the connecting pin center C5 is held at the position C5MAX, the rockable cam 18 is shifted toward and held at the position corresponding to the maximum valve opening of intake valve 19. At this time, the magnitude of valve lift of intake valve 19 is a maximum value. Suppose the center C2 of eccentric cam 12 moves clockwise from the angular position C2OPEN via the angular position C2MAX to the angular position C2CLOSE. In this case, the angular position C2OPEN of center C2 of eccentric cam 12 obtained at the beginning of valve-lift operation is different from the angular position C2CLOSE of center C2 of eccentric cam 12 obtained at the end of valve-lift operation. On the other hand, the angular position C5S of connecting pin center C5 obtained at the beginning of valve-lift operation and the angular position C5S of connecting pin center C5 obtained at the end of valve-lift operation are identical to each other. As shown in FIG. 5, when control shaft 14 is rotated in the counterclockwise direction from the controlled phase shown in FIG. 4 so as to vary the valve lift characteristic (working angle and valve lift) of intake valve 19, the center C4 of rocker arm 16 is shifted to the angular position indicated by C4' and thus the dimensions of the valve operating device vary as indicated by the broken lines of FIG. 5. That is to say, the position of connecting pin center C5, corresponding to the maximum valve lift of intake valve 19, changes from the position indicated by C5MAX to the position indicated by C5MAX'. Owing to the displacement from C5MAX to C5MAX', the position of the center C2 of eccentric cam 12, corresponding to the maximum valve lift, also changes from the position indicated by C2MAX to the position indicated by C2MAX'. In the same manner, the rotation angle of drive shaft 11 from the angular position (C2OPEN) corresponding to the beginning of valve-lift operation to the angular position (C2MAX) corresponding to the maximum valve lift changes from $\theta 1$ to $\theta 1'$, and also the rotation angle of drive shaft 11 from the angular position (C2MAX) corresponding to the maximum valve lift to the angular position (C2CLOSE) corresponding to the end of valve-lift operation changes from $\theta 2$ to $\theta 2'$. The variation ($\theta 1$–$\theta 1'$) of valve-open timing is slightly different from the variation ($\theta 2$–$\theta 2'$) of valve-closure timing. Therefore, assuming that the left-bank drive shaft and right-bank drive shaft rotate in the same rotational direction and the left-bank valve operating device and the right-bank valve operating device are arranged to be substantially mirror-symmetrical with respect to a plane which is mid-way between the axes of the two drive shafts and which is perpendicular to a plane containing the axes, in one of the two banks the position C5MAX of connecting pin center C5 corresponding to the maximum valve lift of intake valve 19, and the aforementioned rotation angles $\theta 1$ and $\theta 2$ of drive shaft 11 vary in the timing-advance direction. Conversely, in the other bank the position C5MAX of connecting pin center C5 corresponding to the maximum valve lift of intake valve 19, and the aforementioned rotation angles $\theta 1$ and $\theta 2$ of drive shaft 11 vary in the timing-retard direction. In this case, the valve lift characteristics of the left and right banks are different from each other. In contrast to the above, in the valve operating device of the shown embodiment, as viewed from the axial direction of drive shaft 11, component parts (12, 13, 15–18) of the variable valve timing and valve lift characteristic mechanism of the valve operating device contained in the left bank and component parts (12, 13, 15–18) of the variable valve timing and valve lift characteristic mechanism of the valve operating device contained in the right bank are arranged or laid out substantially similarly to each other or substantially congruently with each other. Additionally, in both of the left and right banks, the straight line 21 passing through the center C1 of drive shaft 11 and the center C3 of control shaft 14 is set to the predetermined position that the left-bank straight line 21L and the right-bank straight line 21R are rotated about the respective drive shafts 11L and 11R in the same rotational direction by the predetermined same angle α with respect to the valve stem axis 20 (see FIG. 1). Therefore, the variation of the valve lift characteristic of the left-bank valve operating device, occurring owing to a change of angular phase of left-bank control shaft 14L, is identical to that of the right-bank valve operating device, occurring owing to the same angular phase change of right-bank control shaft 14R as the left-bank control shaft 14L. Thus, it is possible to provide the same valve lift characteristic over all of the engine cylinders. In other words, it is unnecessary to drive the drive shafts (11L, 11R) of the two banks in opposite rotational directions. In the same manner as typical V-type engines, the drive shafts (11L, 11R) of two banks can be driven in the same rotational direction by means of a timing chain, a timing belt or the like.

Figure 6:
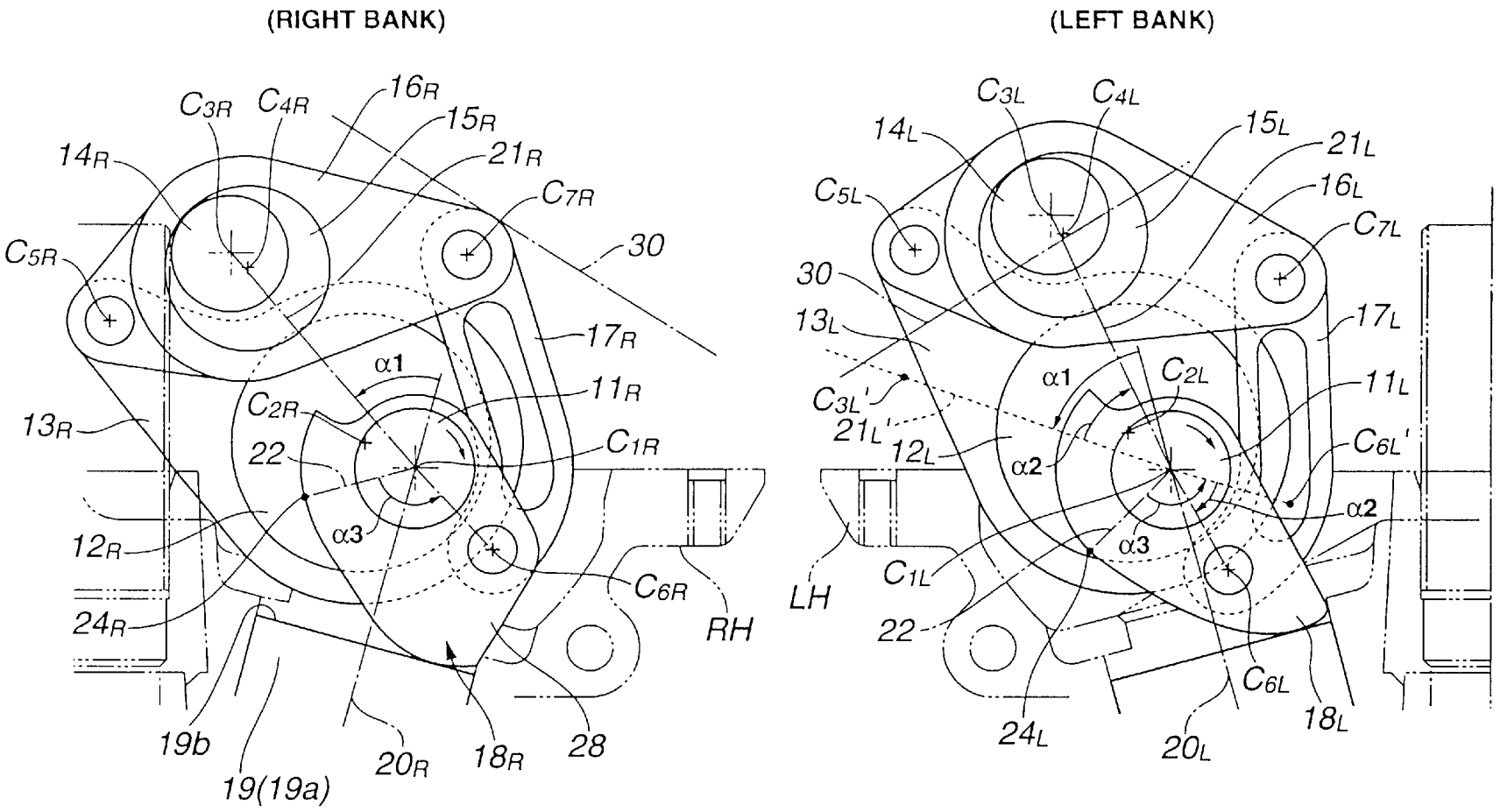
FIG. 6 is a lateral cross-sectional view illustrating left-bank and right-bank cylinder heads of a two-bank internal combustion engine equipped with a valve operating device with a variable valve timing and valve lift characteristic mechanism of a second embodiment.
Figure 7:
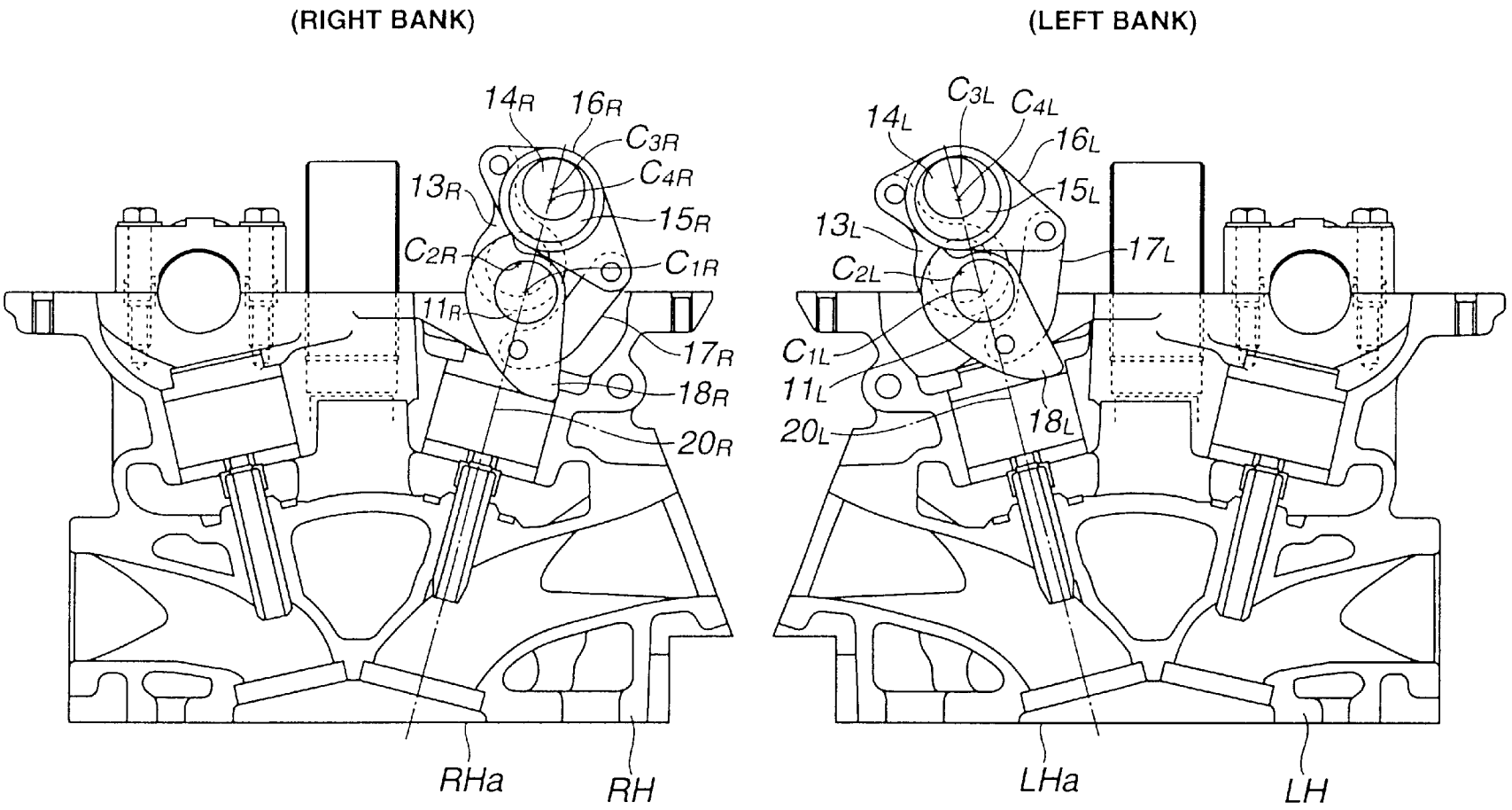
FIG. 7 is a lateral cross-sectional view illustrating left-bank and right-bank cylinder heads of a two-bank internal combustion engine equipped with a valve operating device with a variable valve timing and valve lift characteristic mechanism of a third embodiment.
Figure 8:
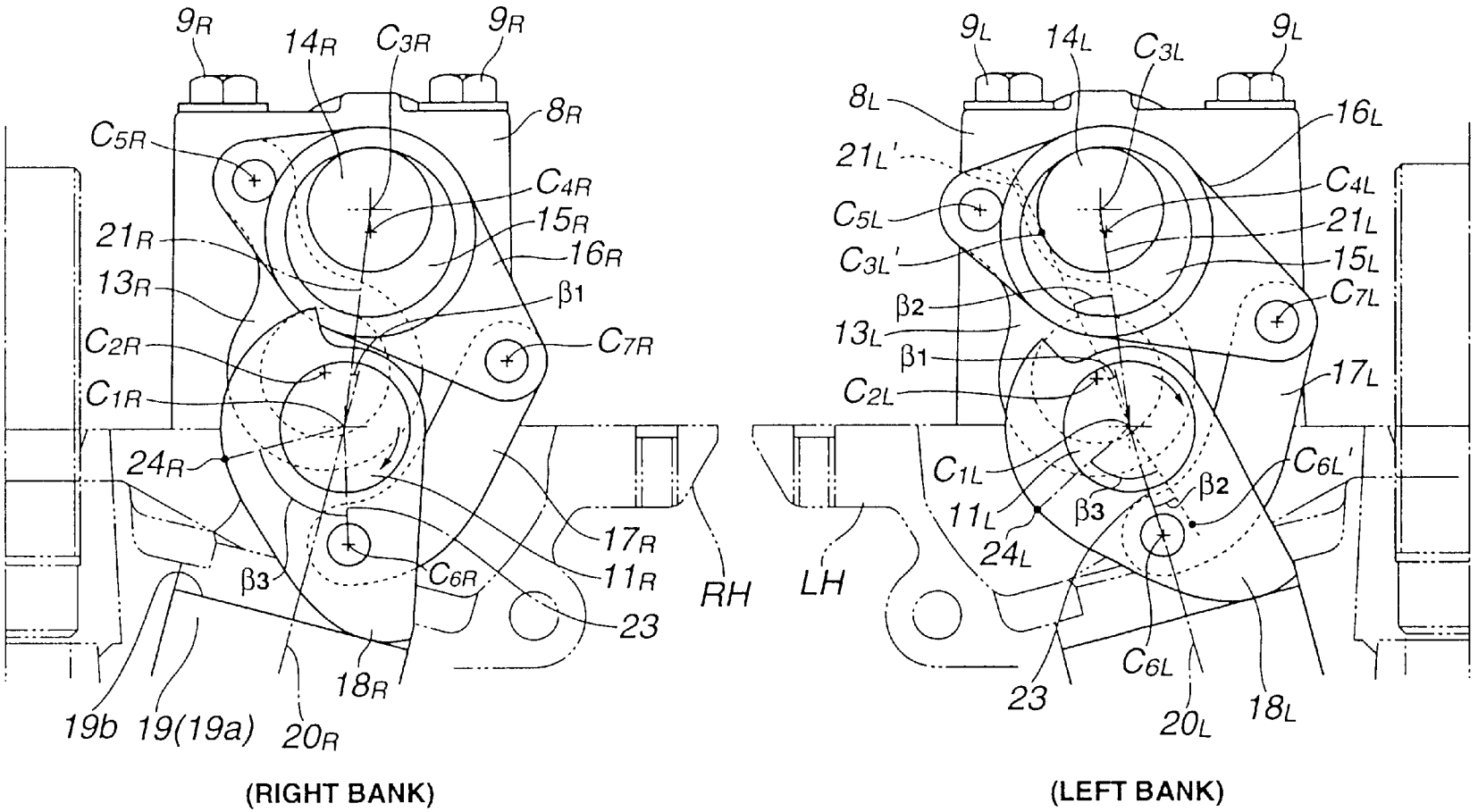
FIG. 8 is a lateral cross-sectional view illustrating left-bank and right-bank cylinder heads of a two-bank internal combustion engine equipped with a valve operating device with a variable valve timing and valve lift characteristic mechanism of a fourth embodiment.

FIGS. 6, 7, and 8, respectively show the second, third and fourth embodiments. The first, second, third, and fourth embodiments are similar to each other. Thus, the same reference signs used to designate elements shown in the first embodiment will be applied to the corresponding elements shown in each of the second, third, and fourth embodiments, for the purpose of comparison among the first, second, third and fourth embodiments.

In the valve operating device of the second embodiment shown in FIG. 6, in order for the degree of freedom (the variation) of the valve lift characteristic to greatly increase, as viewed in the axial direction, in each of the left and right banks, the center C6 of the connecting pin (connecting portion) which mechanically links rockable cam 18 to second link member 17 and whose position corresponds to a state of the maximum valve lift, lies on the prolongation of the line segment (or straight line) 21 between and including the center C1 of drive shaft 11 and the center C3 of control shaft 14, and laid out in the reverse side of the center C3 of control shaft 14, sandwiching drive-shaft center C1 between two centers C3 and C6. That is, in the maximum valve lift state, control-shaft center C3, drive-shaft center C1, and connecting pin center C6 are aligned with each other. This enhances the degree of freedom of working-angle characteristic of the engine valve (intake valve). Furthermore, in the right bank, the straight line 21R through drive-shaft center C1R and control-shaft center C3R is set to a predetermined position that the right-bank straight line 21R is rotated about the drive shaft 11R in the rotational direction opposite to the rotational direction of drive shaft 11R by a predetermined angle α1 with respect to the valve stem axis 20R (see the left-hand side of FIG. 6). Conversely, in the left bank, the straight line 21L through drive-shaft center C1L and control-shaft center C3L is set to a predetermined position that the left-bank straight line 21L is rotated about the drive shaft 11L in the rotational direction of drive shaft 11L by a predetermined angle α2 with respect to the broken line 21L' rotated about the drive shaft 11L in the rotational direction opposite to the rotational direction of drive shaft 11L by the predetermined angle α1 with respect to the valve stem axis 20L (see the right-hand side of FIG. 6). The distance between left-bank drive-shaft center C1L and left-bank control-shaft center C3L and the distance between right-bank drive-shaft center C1R and right-bank control-shaft center C3R are set to be identical to each other. Additionally, in the right bank, the straight line 21R through connecting pin center C6R, drive-shaft center C1R and control-shaft center C3R is set to a predetermined position that the right-bank straight line 21R is rotated about the drive shaft 11R in the rotational direction opposite to the rotational direction of drive shaft 11R by a predetermined angle α3 with respect to a line segment 22 between and including the drive-shaft center C1R and a valve-lift starting point 24R on the cam surface 18*c* of rockable cam 18. In the same manner as right-bank control shaft 14R, in the left bank, the straight line 21L through connecting pin center C6L, drive-shaft center C1L and control-shaft center C3L is set to a predetermined position that the left-bank straight line 21L is rotated about the drive shaft 11L in the rotational direction of drive shaft 11L by a predetermined angle α2 with respect to the broken line 21L' rotated about the drive shaft 11L in the rotational direction opposite to the rotational direction of drive shaft 11L by the predetermined angle α1 with respect to the valve stem axis 20L. The distance between left-bank rockable-cam center C1L and left-bank connecting pin center C6L and the distance between right-bank rockable-cam center C1R and right-bank connecting pin center C6R are set to be identical to each other. That is, as compared to the right bank, the position of the center C3L of left-bank control shaft 14L and the angular phase of left-bank rockable cam 18L are set at specified positions that these are rotated about the drive shaft 11L in the same rotational direction (the rotational direction of drive shaft 11L) by the same angle α2. As a result, the variation of the valve lift characteristic of the left-bank valve operating device, occurring owing to a change of angular phase of left-bank control shaft 14L, is identical to that of the right-bank valve operating device, occurring owing to the same angular phase change of right-bank control shaft 14R as the left-bank control shaft 14L. Thus, the valve operating device of the second embodiment can provide the same effect of the first embodiment. That is, it is possible to provide the same valve lift characteristic over all of the engine cylinders. Additionally, in the second embodiment, it is possible to provide a different position of the center of control shaft 14 relative to drive shaft 11 and a different initial phase of rockable cam 18 at left and right banks. Thus, it is possible to arrange or lay out the control shafts (14L, 14R) and rockable cams (18L, 18R) at optimal locations, considering a limited mounting space, thereby enhancing the design flexibility and the degree of freedom of layout. In more detail, assuming that the center C3L of left-bank control shaft 14L is laid out in the same control-shaft center position C3L'(on the broken line 21L') as the right-bank side, the rocker arm 16L and the substantially ring-shaped link (first link member) 13L tend to project to the lateral sides. In such a case, there is a tendency for the left-bank rocker arm 16L and left-bank first link member 13L to interfere with the cylinder head. This layout is undesirable. To avoid this, in the valve operating device of the second embodiment, the center C3L of left-bank control shaft 14L is laid out at the predetermined position such that the center C3L of left-bank control shaft 14L is rotated about the drive shaft 11L toward the center (see the rightmost end of FIG. 6) of the left-bank cylinder head by the predetermined angle α2 in comparison with the right bank. Therefore, each of the valve operating devices of the left and right banks can be laid out within the overall width of the associated cylinder head. As a consequence, it is possible to apply or mount the variable valve operating device of the second embodiment to or on both of the left and right banks, without changing the overall width of the cylinder head.

A line denoted by reference sign 30 in FIG. 6 indicates a horizontal plane 30 corresponding to the overall height of the right-bank variable valve timing and valve lift characteristic mechanism, on the assumption that the variable valve operating device of the second embodiment is practically applied to an intake-valve side of a V-type internal combustion engine. As can be seen from the level of the horizontal plane 30 corresponding to the overall height of the right-bank variable valve timing and valve lift characteristic mechanism, the overall height of the right-bank valve operating device is dimensioned to be lower than that of the left-bank valve operating device. As viewed from a reduced overall height, in the right-bank valve operating device, in order to reduce the overall height, the center of right-bank control shaft 14R is set at the position that the control-shaft center C3R is greatly rotated about the drive shaft 11R toward the center of the right-bank cylinder head by the predetermined angle $\alpha$1 with regard to the valve stem axis 20R. To realize this, regarding right-bank rockable cam 18R, the angle $\alpha$3 between the connecting pin center C6R shifted to the position corresponding to the maximum valve lift and the valve-lift starting point 24R of rockable cam 18 is set to be relatively remarkably greater than that of the left bank. For this reason, regarding right-bank rockable cam 18R, its cam lobe 28 to which the connecting pin portion C6R is linked, is large-sized in comparison with the left-bank rockable cam 18L. In case that the variable valve operating device of the second embodiment is applied to an intake valve side of a V-type transverse internal combustion engine of a front-engine, front-drive (FF) vehicle, by applying the right-bank variable valve operating device (the left-hand side of FIG. 6) of a relatively lower overall height to a front bank, it is possible to relatively reduce the overall height of the front portion of the vehicle. This is useful or effective or favorable to a hood line (e.g. , a properly slanted hood).

Referring now to FIG. 7, there is shown the valve operating device of the third embodiment. The fundamental structure of the valve operating device of the third embodiment is similar to that of the first embodiment shown in FIGS. 1 through 5. The third embodiment is slightly different from the first embodiment, in that the inclination angle $\alpha$ of straight line 21 to valve stem axis 20 is set to 0° (see FIG. 7). In other words, as viewed from the axial direction of drive shaft 11, in both the left and right banks the drive-shaft center C1 and the control-shaft center C3 are aligned with the valve stem axis 20. According to the structure of the valve operating device of the third embodiment, component parts (containing rockable cam 18L) of the left-bank valve operating device and component parts (containing rockable cam 18R) of the right-bank valve operating device can be communized with each other. Additionally, the left-bank drive shaft 11L, left-bank control shaft 14L, left-bank journal bearing bracket 8L and bolts 9L and the right-bank drive shaft 11R, right-bank control shaft 14R, right-bank journal bearing bracket 8R and bolts 9R are mirror-symmetrical with respect to a plane which is midway between the axes of the two drive shafts and which is perpendicular to a plane containing the axes. This facilitates the engine design and manufacture of the variable valve operating device.

Referring now to FIG. 8, there is shown the valve operating device of the fourth embodiment. The fundamental structure of the valve operating device of the fourth embodiment is similar to that of the second embodiment shown in FIG. 6. In the fourth embodiment, the left-bank drive shaft 11L and left-bank control shaft 14L, and the right-bank drive shaft 11R and right-bank control shaft 14R are also laid out to be mirror-symmetrical with respect to a plane which is mid-way between the axes of the two drive shafts and which is perpendicular to a plane containing the axes. In addition to the above, in the valve operating device of the fourth embodiment, in the right bank, the straight line 21R through drive-shaft center C1R and control-shaft center C3R is set to a predetermined position that the right-bank straight line 21R is rotated about the drive shaft 11R in the rotational direction opposite to the rotational direction of drive shaft 11R by a predetermined angle $\beta$1 with respect to the valve stem axis 20R. On the other hand, in the left bank, the straight line 21L through drive-shaft center C1L and control-shaft center C3L is set to a predetermined position that the left-bank straight line 21L is rotated about the drive shaft 11L in the rotational direction of drive shaft 11L by a predetermined angle $\beta$2 with respect to the broken line 21L' rotated about the drive shaft 11L in the rotational direction opposite to the rotational direction of drive shaft 11L by the predetermined angle $\beta$1 with respect to the valve stem axis 20L. The predetermined angle $\beta$2 is set to be two times greater than the predetermined angle 31. Thus, the angle between valve stem axis 20L and broken line 21L' is equal to the predetermined angle $\beta$1, while the angle between valve stem axis 20L and left-bank straight line 21L is also equal to the predetermined angle $\beta$1, because of $\beta 2 = 2\beta 1$. As can be appreciated from the above, the center C3L of left-bank control shaft 14L is set to the predetermined position that the left-bank control-shaft center C3L is rotated by the same predetermined angle $\beta$1 with respect to the valve stem axis 20L in the opposite rotational direction (corresponding to the rotational direction of drive shaft 11) as compared to the right-bank control shaft 14R. The distance between left-bank drive-shaft center C1L and left-bank control-shaft center C3L is designed to be equal to the distance between right-bank drive-shaft center C1R and right-bank control-shaft center C3R. Additionally, in the right bank, the straight line 23 through the center C1R of oscillating motion of rockable cam 18R and the center C6R of connecting pin linking rockable cam 18R to second link member 17R therevia is set to a predetermined position that the right-bank straight line 23 is offset from a line segment 22 between and including the center C1R of oscillating motion of rockable cam 18 and a valve-lift starting point 24R on the cam surface of rockable cam 18R in the rotational direction opposite to the rotational direction of drive shaft 11R by a predetermined angle $\beta$3. On the other hand, in the same manner as right-bank control shaft 14R, in the left bank, the straight line 23 through the center C1L of oscillating motion of rockable cam 18L and the connecting pin center C6L is set to a predetermined position that the left-bank straight line 23 is rotated about the drive shaft 11L in the rotational direction of drive shaft 11L by a predetermined angle $\beta$2 with respect to the broken line 21L' being offset from the valve stem axis 20L in the rotational direction opposite to the rotational direction of drive shaft 11L by the predetermined angle $\beta$3. The distance between the center C1L of oscillating motion of left-bank rockable cam 18L and left-bank connecting pin center C6L is designed to be equal to the distance between the center C1R of oscillating motion of right-bank rockable cam 18R and right-bank connecting pin center C6R. That is, in the same manner as the second embodiment, in the valve operating device of the fourth embodiment, as compared to the right bank, the position of the center C3L of left-bank control shaft 14L and the angular phase of left-bank rockable cam 18L are set at specified positions that these are rotated about the drive shaft 11L in the same rotational direction (the rotational direction of drive shaft 11L) by the same angle β2. As a result of this, the variation of the valve lift characteristic of the left-bank valve operating device, occurring owing to a change of angular phase of left-bank control shaft 14L, is identical to that of the right-bank valve operating device, occurring owing to the same angular phase change of right-bank control shaft 14R as the left-bank control shaft 14L. Thus, the valve operating device of the fourth embodiment can provide the same effect of the second embodiment, that is, it is possible to provide the same valve lift characteristic over all of the engine cylinders. Additionally, in the fourth embodiment, the left-bank drive shaft 11L and left-bank control shaft 14L are mirror-symmetrical with respect to a plane which is midway between the axes of the two drive shafts and which is perpendicular to a plane containing the axes. Thus, the layout of the inside half of the left-bank cylinder head LH being toward the inside of the V-type engine and mounting thereon the left-bank variable valve operating device and the layout of the inside half of the right-bank cylinder head RH being toward the inside of the V-type engine and mounting thereon the right-bank variable valve operating device can be designed to be symmetrical with each other. This facilitates the engine design and manufacture of the variable valve operating device. According to the structure of the valve operating device of the fourth embodiment, mounting parts (containing journal bearing bracket 8L, mounting bolts 9L and the like) on the left-bank cylinder head as well as component parts of the left-bank valve operating device, and mounting parts (containing journal bearing bracket 8R, mounting bolts 9R and the like) on the right-bank cylinder head as well as component parts of the right-bank valve operating device can be communized with each other. In aforementioned first, second, and fourth embodiments, control-shaft center C3 and connecting pin center C6 are arranged to be opposite to each other with respect to valve stem axis 20 used as a reference. The opposite layout of control-shaft center C3 and connecting pin center C6 with respect to valve stem axis 20 is superior to the other layout that the control-shaft center C3 and the connecting pin center C6 are both located in the same side of valve stem axis 20, from the viewpoint of enhanced bearing strength, the enhanced degree of freedom of layout, enhanced design flexibility and the enhanced reliability and durability of the valve operating device.

Figure 9:
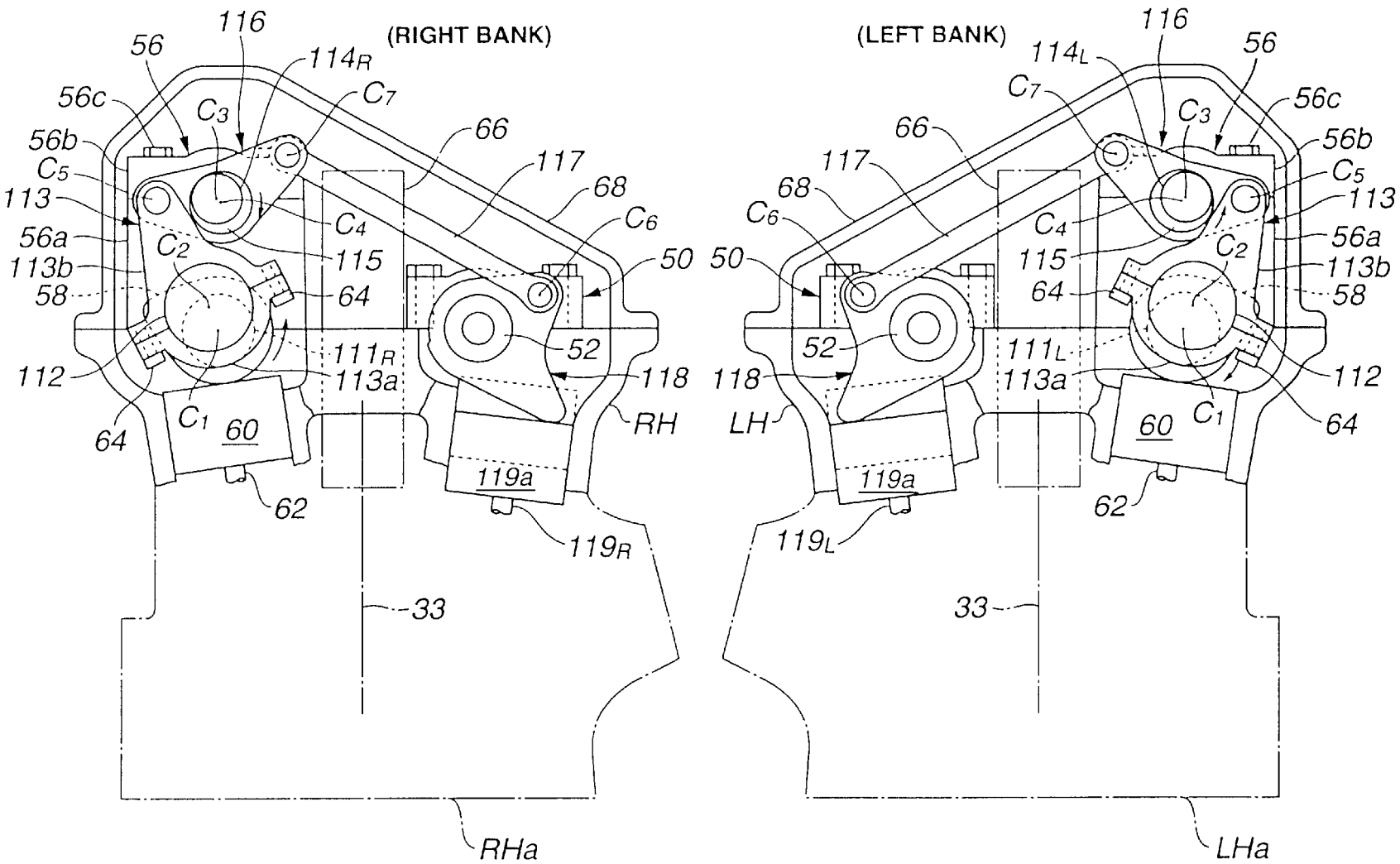
FIG. 9 is a lateral cross-sectional view illustrating left-bank and right-bank cylinder heads of a two-bank internal combustion engine equipped with a valve operating device with a variable valve timing and valve lift characteristic mechanism of a fifth embodiment.
Figure 10:
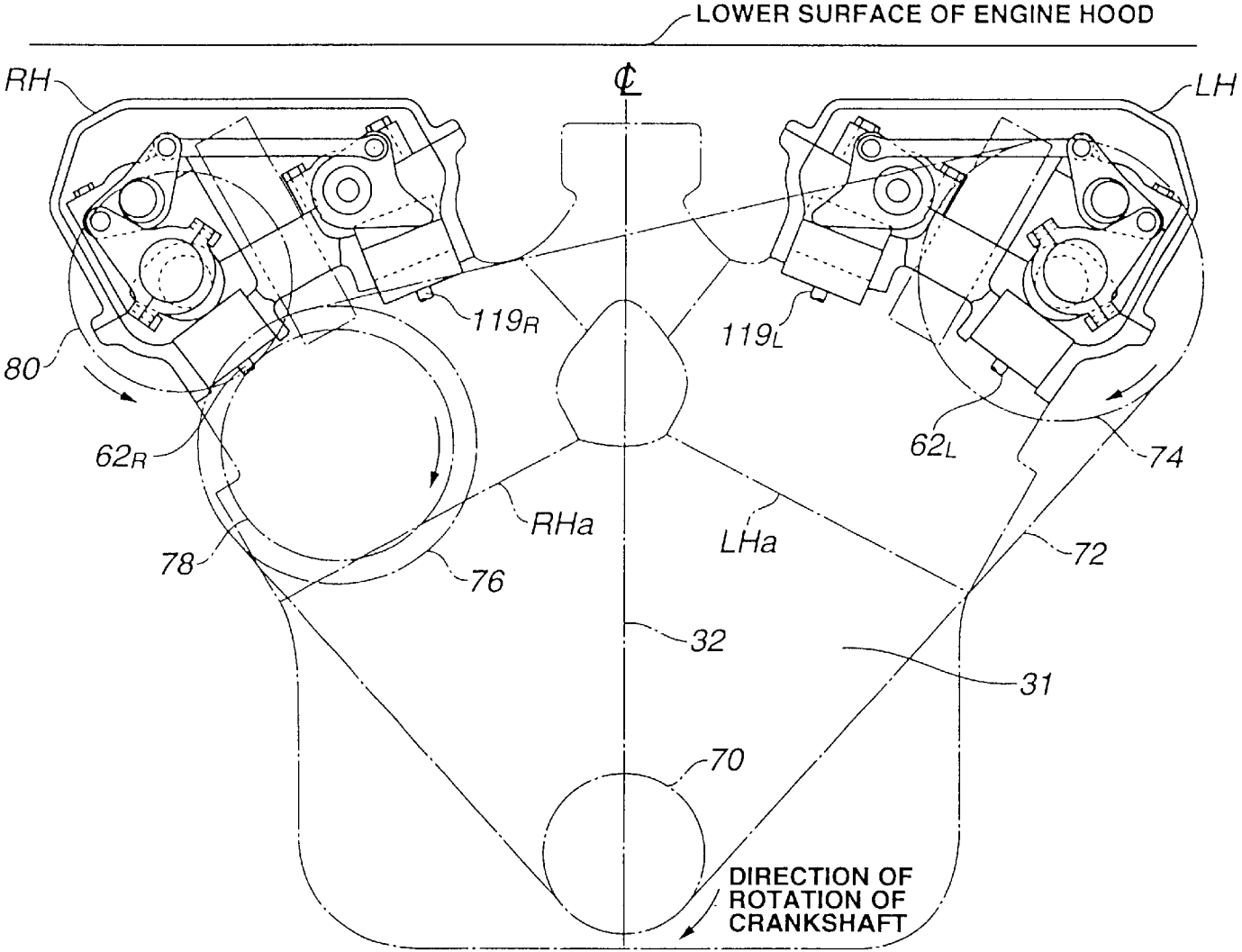
FIG. 10 is a partial cutaway view from the front of a V-type internal combustion engine to which the valve operating device of the fifth embodiment is applied.
Figure 11:
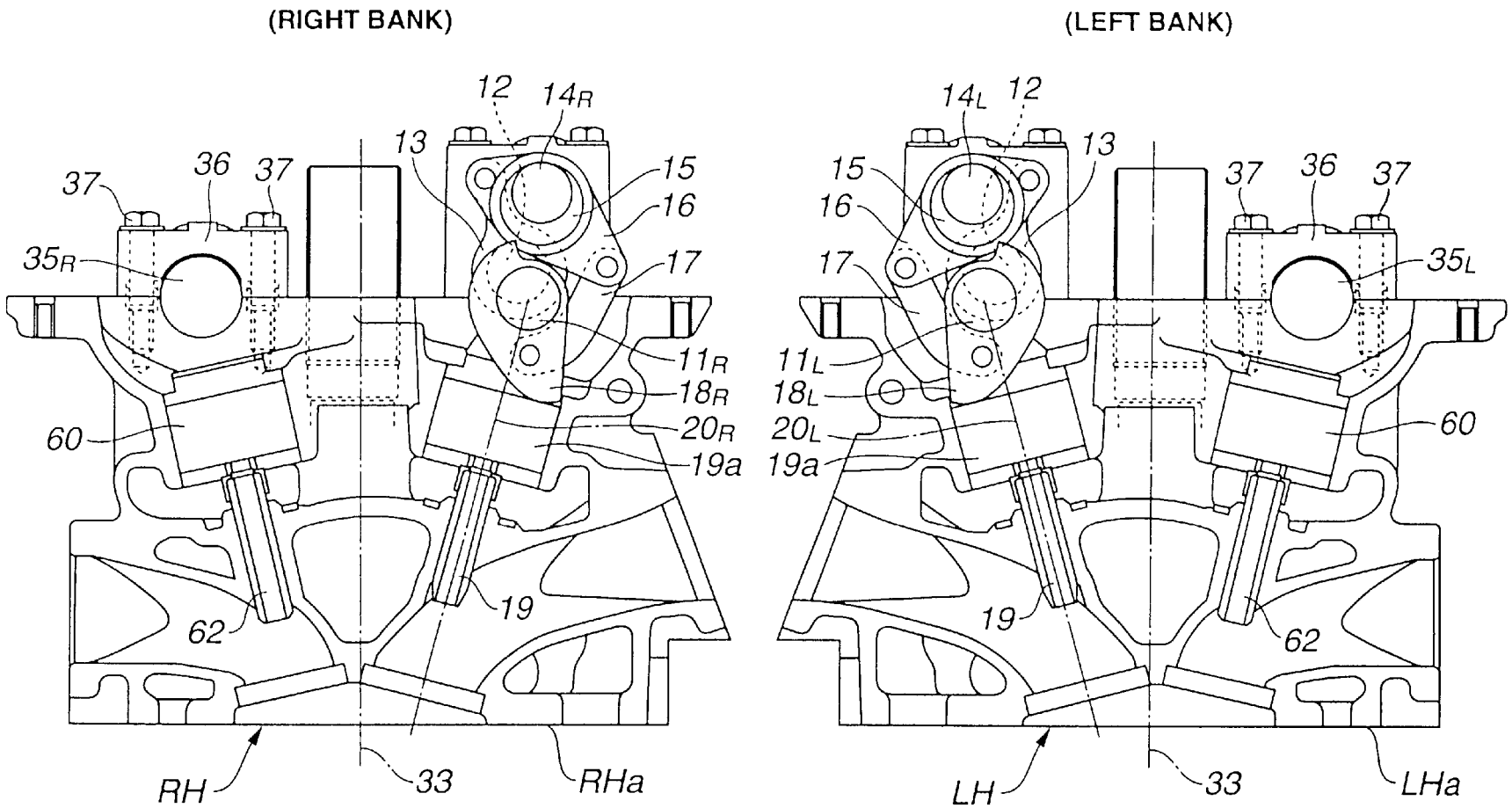
FIG. 11 is a lateral cross-sectional view illustrating left-bank and right-bank cylinder heads of a two-bank internal combustion engine equipped with a valve operating device with a variable valve timing and valve lift characteristic mechanism of a sixth embodiment.

Referring now to FIGS. 9 and 10, there is shown the valve operating device of the fifth embodiment. In FIG. 9, a cylinder-block mounting surface RHa of right-bank cylinder head RH and a cylinder-block mounting surface LHa of left-bank cylinder head LH are illustrated in the same plane, however, as can be seen from the partial cutaway view of the V-type engine of FIG. 10, these mounting surfaces RHa and LHa are actually inclined to each other at a predetermined bank angle. In the fifth embodiment of FIGS. 9 and 10, as viewed from the front of the V-type engine in the same axial direction of left-bank and right-bank drive shafts 11L and 11R, the left-bank and right-bank valve operating devices are laid our or arranged to be substantially mirror-symmetrical with respect to a bank centerline (i.e., a centerline of the two banks) 32. In the fifth embodiment shown in FIGS. 9 and 10, elements or component parts denoted by reference signs 111R, 111L, 112, 113, 113*b*, 114R, 114L, 115, 116, 117, 118, 119R, 119L, and 119*a* respectively mean almost equivalent to elements or component parts denoted by reference signs 11R, 11L, 12, 13, 13*b*, 14R, 14L, 15, 16, 17, 18, 19R, 19L, and 19*a* shown in the first, second, third and fourth embodiments. Detailed description of elements 111R, 111L, 112, 113, 113*b*, 114R, 114L, 115, 116, 117, 118, 119R, 119L, and 119*a* will be omitted because the above description thereon seems to be self-explanatory. On V-type internal combustion engines, the left and right banks are inclined to the outside at a predetermined bank angle. In take valves 119 of an induction system are arranged to be toward the inside of the two banks with respect to a cylinder axis 33 of each of the two banks. Exhaust valves 62 of an exhaust system are arranged to be toward the outside of the two banks with respect to the cylinder axis 33 of each of the two banks. Therefore, the upper surface of a rocker cover 68 is laid out to be substantially parallel to the lower surface of the hood. The space above a valve lifter 60 of exhaust valve 62 located at the outside of each bank, is relatively wider than the space above a valve lifter 119*a* of intake valve 119 located at the inside of each bank. Therefore, in the fifth embodiment, almost all of component parts of the intake-valve operating device which variably controls valve timing and valve lift characteristic (working angle and valve lift) of intake valve 119, are located outside of the cylinder axis 33, that is, outside of each of the two banks. As a result of this, the overall height of the engine can be effectively reduced, thus ensuring easy mounting of the two-bank engine in the engine room. To be concrete, in the variable valve operating device of the fifth embodiment, the drive shaft 111 rotating in synchronism with rotation of the engine crankshaft, the eccentric cam 112 provided eccentrically to drive shaft 111, the substantially ring-shaped link (first link member) 113 fitted onto eccentric cam 112 to permit relative rotation of first link member 113 to eccentric cam 112, the control shaft 114 located substantially parallel to drive shaft 111 and rotated to and held at a desired angular position based on engine operating conditions, the control cam 115 provided eccentrically to control shaft 114, the rocker arm 116 fitted onto control cam 115 to permit relative rotation of rocker arm 116 to control cam 115 and linked at one end to the tip end 113*b* of first link member 113, are all laid out at the outside of each of the banks with respect to a plug post 66 which extends along the cylinder axis 33 as viewed in the axial direction. On the other hand, of component parts of the variable valve operating device, the rockable cam 118 opening and closing the associated intake valve 119, is located above the intake valve 119, that is, at the inside of each of the banks. On the other hand, the rod-shaped link (second link member) 117, which is linked to each of rocker arm 116 and rockable cam 118 to permit relative rotation of second link member 117 to each of rocker arm 116 and rockable cam 118, is laid out in such a manner as to extend over both the outside of each of the banks (i.e., the exhaust valve side) and the inside of each of the banks (i.e., the intake valve side). That is, the rod-shaped link (second link member) 117 extends from the exhaust valve side to the intake valve side in a manner so as to cross the cylinder axis 33. The previously-noted drive shaft 111 has a rotary cam 58 fixedly connected thereto or integrally formed therewith, for opening and closing the exhaust valve 62 via the valve lifter 60. In other words, drive shaft 111 also serves as the camshaft for exhaust valve 62. Thus, the valve operating device of the fifth embodiment shown in FIGS. 10 and 11 is simple in structure. Drive shaft 111 is rotatably supported by means of a lower journal bearing bracket 56*a* and a semi-circular camshaft journal bearing portion (not numbered) of the cylinder head (RH, LH). On the other hand, control shaft 114 is rotatably supported by means of the lower journal bearing bracket 56*a* and an upper journal bearing bracket 56*b* serving as a bearing cap. Journal bearing brackets 56*a* and 56*b* are fixedly connected to or mounted on the cylinder head (RH, LH) by means of common bolts 56*c*, thereby enabling a more simple structure of the variable valve operating device. In order to be able to install substantially ring-shaped link (first link member) 113 on eccentric cam 112 from the rear of the engine, the substantially ring-shaped link is formed as a half-split structure, namely upper and lower halves 113*b* and 113*a* which are fixedly connected to the outer periphery of eccentric cam 112 by bolts 64, while sandwiching the eccentric cam between them. Rocker cam 118 is oscillatingly or rockably fitted onto a support shaft 52. Support shaft 52 is supported on the cylinder head (RH. LH) via a bracket 50, so that the support shaft extends parallel to drive shaft 111 in the cylinder-row direction. The working principle of the variable valve operating device of each of the banks is essentially identical to that of the first embodiment shown in FIGS. 4 and 5. That is, when control shaft 114 is rotated or driven such that the maximum valve lift is reduced, the position of the center C2MAX of eccentric cam 112, corresponding to the maximum valve lift of intake valve 119, changes in the timing-retard direction or in the timing-advance direction. As discussed above, in the valve operating device of the fifth embodiment of FIGS. 9 and 10, the left-bank and right-bank valve operating devices are substantially symmetrical with each other with respect to the bank centerline 32. Assuming that the rotational direction of left-bank drive shaft 111L and the rotational direction of right-bank drive shaft 111R are identical to each other, in a first bank of the two banks the position of the center C2MAX of eccentric cam 112, corresponding to the maximum valve lift, tends to change in the timing-advance direction, whereas in the second bank the position of the center C2MAX of eccentric cam 112, corresponding to the maximum valve lift, tends to change in the timing-retard direction. In this case, valve lift characteristics of the left and right banks undesirably differ from each other. For the reasons set forth above, in the fifth embodiment, the drive shafts (11L, 111R) of the left and right banks are driven in the opposite rotational directions, as viewed in the same axial direction. As can be seen from the diagrams shown in FIGS. 9 and 10, the rotational direction of right-bank drive shaft 111R is set to be the counterclockwise direction, whereas the rotational direction of left-bank drive shaft 111L is set to be the clockwise direction. The rotational direction of right-bank control shaft 114R, decreasing the valve lift, is set to be the clockwise direction, while the rotational direction of left-bank control shaft 114L, decreasing the valve lift, is set to be the counterclockwise direction. In other words, as viewed from the back side of FIGS. 9 and 10, the right-bank valve operating device is essentially identical to the left-bank valve operating device in layout, and additionally the rotational direction of right-bank drive shaft 111R is set to be identical to that of left-bank drive shaft 111L and the rotational direction of right-bank control shaft 114R is set to be identical to that of left-bank control shaft 114L. Therefore, in the same manner as the cylinder head (RH, LH) and intake (119R, 119L) and exhaust valves (62R, 62L), the left-bank and right-bank valve operating devices are mirror-symmetrical with respect to the bank centerline 32, and additionally the valve lift characteristic of the left-bank valve operating device is identical to that of the right-bank valve operating device. This avoids an undesirable situation that the eccentric-cam center C2MAX of the first bank, corresponding to the maximum valve lift, changes in the phase-advance direction, whereas the eccentric-cam center C2MAX of the second bank, corresponding to the maximum valve lift, changes in the phase-retard direction.

Hereinafter described in detail in reference to FIG. 10 is the concrete structure needed to rotate left-bank and right-bank drive shafts 111L and 111R in the opposite rotational directions.

A crank sprocket 70 is fixedly mounted on one end of the engine crankshaft (not shown). Crank sprocket 70 rotates together with the crankshaft in the clockwise direction (viewing FIG. 10). A timing chain 72 is wound on all of the crank sprocket 70, a first sprocket 74 located in the left bank, and a second sprocket 76 located in the right bank. Second sprocket 76 is often called as an "idler sprocket". Thus, first and second sprockets 74 and 76 rotate in the same rotational direction. Owing to setting of the number of teeth among crank sprocket 70, and first and second sprockets 74 and 76, the rotational speed of each of first and second sprockets 74 and 76 is reduced to one-half the rotational speed of crank sprocket 70. As can be seen from the right-hand side of FIG. 10, first sprocket 74 is fixed to one end of left-bank drive shaft 11L, so that the first sprocket rotates together with the left-bank drive shaft. Thus, left-bank drive shaft 111L rotates in the same direction (the clockwise direction as viewed from the partial cutaway view of FIG. 10) as the crankshaft at one-half the rotational speed of the crankshaft. As can be seen from the left-hand side of FIG. 10, a first reverse-rotational pulley 78 and a second reverse-rotational pulley 80 are provided in the right bank. First and second reverse-rotational pulleys 78 and 80 are two meshing gears with the same number of teeth, and therefore the first and second reverse-rotational pulleys rotate in the opposite directions at the same rotational speed. First reverse-rotational pulley 78 is coaxially arranged with and fixedly mounted on second sprocket 76, so that first reverse-rotational pulley 78 rotates together with second sprocket 76. On the other hand, second reverse-rotational pulley 80 is fixedly mounted on one end of right-bank drive shaft 111R, so that second reverse-rotational pulley 80 rotates together with right-bank drive shaft 111R. Thus, right-bank drive shaft 11R rotates in the opposite direction (the counterclockwise direction as viewed from the partial cutaway view of FIG. 10) at one-half the rotational speed of the crankshaft. As discussed above, the chain-drive structure for the left-bank and right-bank drive shafts is simple, however, it is possible to rotate left-bank and right-bank drive shafts 111L and 111R in the opposite directions at the same rotational speed.

Figure 12:
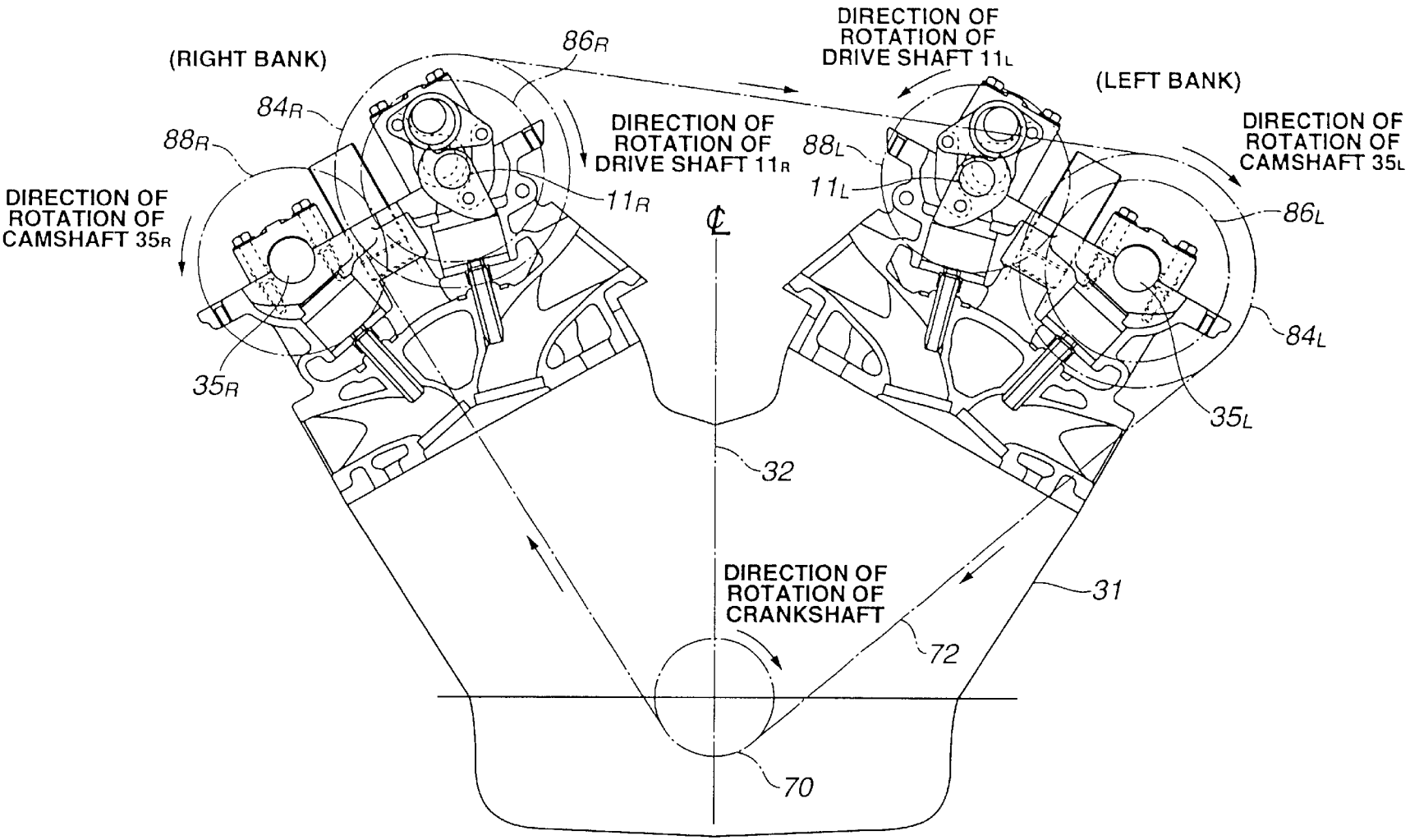
FIG. 12 is a partial cutaway view from the front of a V-type internal combustion engine to which the valve operating device of the sixth embodiment is applied.

Referring now to FIGS. 11 and 12, there is shown the valve operating device of the sixth embodiment. The concrete structure and fundamental working principle of the valve operating device of the sixth embodiment are essentially identical to those of the first embodiment. Therefore, the same reference signs used to designate elements shown in the first embodiment will be applied to the corresponding elements shown in the sixth embodiment, for the purpose of comparison between the first and sixth embodiments.

In the sixth embodiment, although in FIG. 11 a cylinder-block mounting surface RHa of right-bank cylinder head RH and a cylinder-block mounting surface LHa of left-bank cylinder head LH are illustrated in the same plane, these mounting surfaces RHa and LHa are actually inclined to each other at a predetermined bank angle (see FIG. 12). In each of left-bank and right-bank cylinder heads (LH, RH), intake valves 19 are arranged to be toward the inside of the two banks, whereas exhaust valves 62 are arranged to be toward the outside of the two banks. A camshaft 35 is located above exhaust valve 62 for opening and closing the exhaust valve via valve lifter 60. Camshaft 35 is rotatably supported on each of the cylinder heads (RH, LH) by means of a camshaft journal bearing bracket 36 serving as a bearing cap and a semi-circular camshaft journal bearing portion (not numbered) of the cylinder head (RH, LH). Camshaft journal bearing bracket 36 and the semi-circular camshaft journal bearing portion of the cylinder head (RH, LH) are fixedly connected to each other by mounting bolts 37, while sandwiching camshaft 35 between them and permitting rotational motion of the camshaft. In the same manner as the fifth embodiment of FIGS. 9 and 10, as viewed in the same axial direction of left-bank and right-bank drive shafts 11L and 11R, in the sixth embodiment the left-bank and right-bank valve operating devices are laid out to be substantially mirror-symmetrical with respect to a bank centerline 32. Additionally, the rotational directions of left-bank and right-bank drive shafts 11L and 11R are set so that drive shafts 11L and 11R rotate in the opposite directions. Furthermore, the rotational directions of left-bank and right-bank control shafts 14L and 14R are set so that control shafts 14L and 14R rotate in the opposite directions. Therefore, it is possible to equally set intake-valve lift characteristics of the left and right banks, so that the variation of the valve lift characteristic of the left-bank valve operating device, occurring owing to a change of angular phase of left-bank control shaft 14L, is identical to that of the right-bank valve operating device, occurring owing to the same angular phase change of right-bank control shaft 14R as the left-bank control shaft 14L. In the sixth embodiment, all of component parts of the intake-valve operating device which variably controls valve timing and valve lift characteristic (working angle and valve lift) of intake valve 19, are located inside of the cylinder axis 33, that is, inside of each of the two banks. As compared to the valve operating device of the fifth embodiment of FIGS. 9 and 10 in which second link member 117 of the variable valve operating device extends from the exhaust valve side to the intake valve side and crosses the cylinder axis 33, the valve operating device of the sixth embodiment of FIGS. 11 and 12 is inferior to that of the fifth embodiment from the viewpoint of the reduced overall height of the engine. However, in the sixth embodiment, there is no need to lay out the second link member of the variable valve operating device from the exhaust valve side to the intake valve side. Therefore, the valve operating device of the sixth embodiment is very simple in structure.

Hereunder described in detail in reference to FIG. 12 is the concrete structure needed to rotate left-bank and right-bank drive shafts 11L and 11R in the opposite rotational directions.

Timing chain 72 is wound on all of crank sprocket 70, a right-bank cam sprocket 84R, and a left-bank cam sprocket 84L. Owing to setting of the number of teeth among crank sprocket 70, and right-bank and left-bank cam sprockets 84R and 84L, the rotational speed of each of right-bank and left-bank cam sprockets 84R and 84L is reduced to one-half the rotational speed of crank sprocket 70. Additionally, right-bank and left-bank cam sprockets 84R and 84L rotate in the same direction as crank sprocket 70. A pair of meshing gears, namely a first gear 86 and a second gear 88, are provided in each of the left and right banks. The meshing gear pair (86, 88) has the same number of teeth, and therefore first and second gears 86 and 88 rotate in the opposite directions at the same rotational speed. First gear 86 of each bank is coaxially arranged with and fixedly mounted on cam sprocket 84, so that first gear 86 rotates together with cam sprocket 84. In the right bank, right-bank cam sprocket 84R is fixedly mounted on one end of the drive shaft 11R of the intake valve side, while right-bank second gear 88R is fixedly mounted on one end of the camshaft 35R of the exhaust valve side. Therefore, right-bank drive shaft 11R rotates in the same direction as the crankshaft at one-half the rotational speed of the crankshaft. Right-bank, exhaust-valve camshaft 35R rotates in the opposite direction at one-half the rotational speed of the crankshaft. On the other hand, in the left bank, left-bank cam sprocket 84L is fixedly mounted on one end of the camshaft 35L of the exhaust valve side. The second gear 88L is fixedly mounted on one end of the drive shaft 11L of the intake valve side. Therefore, left-bank drive shaft 11L rotates in the direction opposite to the rotational direction of the crankshaft at one-half the rotational speed of the crankshaft. Left-bank, exhaust-valve camshaft 35L rotates in the same direction as the crankshaft at one-half the rotational speed of the crankshaft. The structure of the valve operating device of the sixth embodiment of FIGS. 11 and 12 does not require idler pulley (second sprocket) used in the fifth embodiment of FIGS. 9 and 10. Though the valve operating device of the sixth embodiment is very simple in structure, it is possible to rotate left-bank and right-bank drive shafts 11L and 11R in the opposite directions at the same rotational speed and also to rotate left-bank and right-bank exhaust-valve camshafts 35L and 35R in the opposite directions at the same rotational speed.

For the purpose of simplification of the disclosure, FIGS. 1 and 2 (first embodiment), FIG. 6 (second embodiment), FIG. 7 (third embodiment), FIG. 8 (fourth embodiment), FIGS. 9 and 10 (fifth embodiment), and FIGS. 11 and 12 (sixth embodiment) show only the particular phase corresponding to the maximum valve lift. Actually, in the same manner as typical multiple cylinder engines, the timing at which the intake valve reaches the maximum valve lift is set to be different for every engine cylinder, and thus each cylinder experiences in turn the maximum valve lift. In other words, the intake valves of a plurality of engine cylinders never reach their maximum valve lift points at the same time.

In the shown embodiments, although a valve-operating device equipped with a variable valve timing and valve lift characteristic mechanism is used for only intake valves employed in a V-type combustion engine for the sake of illustrative simplicity, it will be appreciated that the valve-operating device of the invention may be applied to exhaust valves usually arranged toward the outside of each of left and right cylinder banks of a V-type engine.

In the shown embodiments, although a valve-operating device of the present invention is exemplified in a V-type combustion engine with two banks and a variable valve timing and valve lift characteristic mechanism, the device of the invention may be applied to the other two-bank engine such as a horizontally opposed cylinder engine containing a typical flat four cylinder engine, a flat six cylinder engine or the like.

As will be appreciated from the above, there are at least two features being common to all of the shown embodiments. First, as viewed in the same axial direction, the lifting direction of left-bank rockable cam 18L relative to the rotational direction of left-bank drive shaft 11L and the lifting direction of right-bank rockable cam 18R relative to the rotational direction of right-bank drive shaft 11R are set to be identical to each other. The lifting direction is defined as a direction of oscillating motion of rockable cam 18 from a position that the valve begins to lift to a position that the valve reaches the maximum valve lift, or as a direction of oscillating motion of rockable cam 18 from the position that the valve reaches the maximum valve lift to a position that the valve re-seats and thus the lifting action of the valve ends. Thus, it is possible to substantially equally set valve lift characteristics of left and right banks, in such a manner that the valve lift characteristic (working angle and valve lift) of the left bank is substantially identical to that of the right bank. Secondly, as viewed in the same axial direction, the rotational direction of left-bank control shaft 14L relative to the rotational direction of left-bank drive shaft 11L and the rotational direction of right-bank control shaft 14R relative to the rotational direction of right-bank drive shaft 11R are set to be identical to each other. Thus, it is possible to substantially equally set intake-valve lift characteristics of the left and right banks, so that the variation of the valve lift characteristic of the left-bank valve operating device, occurring owing to a change of angular phase of left-bank control shaft 14L, is substantially identical to that of the right-bank valve operating device, occurring owing to the same angular phase change of right-bank control shaft 14R as the left-bank control shaft 14L.

The entire contents of Japanese Patent Application No. P2000-250838 (filed Aug. 22, 2000) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An internal combustion engine with a crankshaft and two cylinder banks, each cylinder bank having a cylinder head and a valve operating device enabling both valve timing and valve lift characteristic to be varied, each valve operating device comprising:

a drive shaft installed in the cylinder head of each cylinder bank and rotating in synchronism with rotation of the crankshaft, the drive shaft having a center and an axis of rotation;

an eccentric cam fixedly connected to the drive shaft so that a center of the eccentric cam is eccentric with respect to the center of the drive shaft;

a rockable cam arranged to drive at least one engine valve;

a power-transmission mechanism mechanically linking the eccentric cam to the rockable cam;

a control mechanism provided for varying an attitude of the power-transmission mechanism; and as viewed in the same axial direction, a lifting direction of the rockable cam arranged in a first one of the two cylinder banks relative to a rotational direction of the drive shaft arranged in the first cylinder bank, and a lifting direction of the rockable cam arranged in the second cylinder bank relative to a rotational direction of the drive shaft arranged in the second cylinder bank are set to be identical to each other.

2. The internal combustion engine as claimed in claim 1, wherein:

the power-transmission mechanism comprises a first link member fitted to an outer periphery of the eccentric cam so as to be relatively rotatable about the eccentric cam, a rocker arm whose one end is linked to a tip end of the first link member so as to be rotatable relative to the first link member, and a second link member linked to both the other end of the rocker arm and the rockable cam so as to be rotatable relative to both the rocker arm and the rockable cam;

the control mechanism comprises a control shaft extending substantially parallel to the drive shaft and rotated toward and held at an angular position based on engine operating conditions, and a control cam fixedly connected to the control shaft so that a center of the control cam is eccentric with respect to a center of the control shaft; and the rocker arm is fitted to an outer periphery of the control cam so as to be relatively rotatable about the control cam.

3. The internal combustion engine as claimed in claim 2, wherein:

as viewed in the same axial direction, a rotational direction of the control shaft arranged in the first cylinder bank relative to the rotational direction of the drive shaft arranged in the first cylinder bank, and a rotational direction of the control shaft arranged in the second cylinder bank relative to the rotational direction of the drive shaft arranged in the second cylinder bank are set to be identical to each other.

4. The internal combustion engine as claimed in claim 1, wherein:

as viewed in the same axial direction and when using a valve stem axis of the engine valve as a reference, the valve operating device arranged in the first cylinder bank and the valve operating device arranged in the second cylinder bank are laid out substantially similarly to each other; and the rotational direction of the drive shaft arranged in the first cylinder bank and the rotational direction of the drive shaft arranged in the second cylinder bank are set to be identical to each other.

5. An internal combustion engine with a crankshaft and two cylinder banks, each cylinder bank having a cylinder head and a valve operating device enabling both valve timing and valve lift characteristic to be varied, each valve operating device comprising:

a drive shaft installed in the cylinder head of each cylinder bank and rotating in synchronism with rotation of the crankshaft, the drive shaft having a center and an axis of rotation;

a control shaft extending substantially parallel to the drive shaft and rotated toward and held at an angular position based on engine operating conditions;

a rockable cam fitted to an outer periphery of the drive shaft so as to be relatively rotatable about the drive shaft and to drive at least one engine valve;

an eccentric cam fixedly connected to the drive shaft so that a center of the eccentric cam is eccentric with respect to the center of the drive shaft;

a first link member fitted to an outer periphery of the eccentric cam so as to be relatively rotatable about the eccentric cam;

a control cam fixedly connected to the control shaft so that a center of the control cam is eccentric with respect to a center of the control shaft;

a rocker arm whose one end is linked to a tip end of the first link member so as to be rotatable relative to the first link member, the rocker arm being fitted to an outer periphery of the control cam so as to be relatively rotatable about the control cam;

a second link member linked to both the other end of the rocker arm and the rockable cam so as to be rotatable relative to both the rocker arm and the rockable cam;

as viewed in the same axial direction and when using a valve stem axis of the engine valve as a reference, the valve operating device arranged in the first cylinder bank and the valve operating device arranged in the second cylinder bank are laid out substantially similarly to each other; and the rotational direction of the drive shaft arranged in the first cylinder bank and the rotational direction of the drive shaft arranged in the second cylinder bank are set to be identical to each other.

6. The internal combustion engine as claimed in claim 5, wherein:

a straight line through the center of the drive shaft arranged in the first cylinder bank and a center of the control shaft arranged in the first cylinder bank is set to a predetermined position that the straight line is rotated about the drive shaft arranged in the first cylinder bank in a rotational direction by an angle with respect to the valve stem axis of the engine valve arranged in the first cylinder bank; and a straight line through the center of the drive shaft arranged in the second cylinder bank and a center of the control shaft arranged in the second cylinder bank is set to a predetermined position that the straight line is rotated about the drive shaft arranged in the second cylinder bank in the same rotational direction by the same angle with respect to the valve stem axis of the engine valve arranged in the second cylinder bank.

7. The internal combustion engine as claimed in claim 5, wherein:

a distance between the center of the drive shaft arranged in the first cylinder bank and a center of the control shaft arranged in the first cylinder bank and a distance between the center of the drive shaft arranged in the second cylinder bank and a center of the control shaft arranged in the second cylinder bank are set to be identical to each other;

a distance between the center of the drive shaft arranged in the first cylinder bank and a center of a connecting portion between the rockable cam and the second link member both arranged in the first cylinder bank and conditioned in a maximum valve-lift state in which a magnitude of valve lift of the engine valve is a maximum value, and a distance between the center of the drive shaft arranged in the second cylinder bank and a center of a connecting portion between the rockable cam and the second link member both arranged in the second cylinder bank and conditioned in the maximum valve-lift state are set to be identical to each other;

as compared to the first cylinder bank, the center of the control shaft arranged in the second cylinder bank is set to a predetermined position that the center of the control shaft arranged in the second cylinder bank is rotated about the drive shaft arranged in the second cylinder bank in a predetermined rotational direction by a predetermined angle $\alpha 2$ with respect to the valve stem axis of the engine valve arranged in the second cylinder bank; and as compared to the first cylinder bank, the center of the connecting portion arranged in the second cylinder bank is set to a predetermined position that the center of the connecting portion arranged in the second cylinder bank is rotated about the drive shaft arranged in the second cylinder bank in the same predetermined rotational direction as the center of the control shaft arranged in the second cylinder bank by the same predetermined angle $\alpha 2$ as the center of the control shaft arranged in the second cylinder bank with respect to a line segment between and including a center of oscillating motion and a valve-lift starting point of the rockable cam arranged in the second cylinder bank.

8. The internal combustion engine as claimed in claim 5, wherein:

in each of the two cylinder banks, a center of a connecting portion between the rockable cam and the second link member conditioned in a maximum valve-lift state in which a magnitude of valve lift of the engine valve is a maximum value, is laid out to lie on a prolongation of the straight line through the center of the drive shaft and a center of the control shaft.

9. The internal combustion engine as claimed in claim 5, wherein:

in each bank of the two cylinder banks, the center of the drive shaft and a center of the control shaft are aligned with the valve stem axis of the engine valve.

10. The internal combustion engine as claimed in claim 7, wherein:

the center of the control shaft arranged in the first cylinder bank is set to a predetermined position that the center of the control shaft arranged in the first cylinder bank is rotated about the drive shaft arranged in the first cylinder bank in a predetermined rotational direction by a predetermined angle $\beta 1$ with respect to the valve stem axis of the engine valve arranged in the first cylinder bank; and the center of the control shaft arranged in the second cylinder bank is set to a predetermined position that the center of the control shaft arranged in the second cylinder bank is rotated about the drive shaft arranged in the second cylinder bank in a rotational direction opposite to the predetermined rotational direction of the control shaft arranged in the first cylinder bank by the same predetermined angle $\beta 1$ as the center of the control shaft arranged in the first cylinder bank with respect to the valve stem axis of the engine valve arranged in the second cylinder bank.

11. The internal combustion engine as claimed in claim 5, wherein:

in at least one of the two cylinder banks, as viewed in an axial direction, a center of a connecting portion between the rockable cam and the second link member both conditioned in the maximum valve-lift state are laid out in a reverse side of a center of the control shaft with respect to the valve stem axis of the engine valve.

12. The internal combustion engine as claimed in claim 5, wherein:

in at least one of the two cylinder banks, the center of the control shaft is laid out to be toward a center of the cylinder head with respect to the valve stem axis of the engine valve.

13. The internal combustion engine as claimed in claim 12, wherein:

the valve operating device of the internal combustion engine with the crankshaft and the two cylinder banks comprises an intake valve operating device of a V-type transverse internal combustion engine;

the center of the control shaft arranged in a front cylinder bank of the two cylinder banks is laid out to be toward the center of the cylinder head with respect to the valve stem axis of the intake valve.

14. The internal combustion engine as claimed in claim 1, wherein:

as viewed in the same axial direction, the valve operating device arranged in the first cylinder bank and the valve operating device arranged in the second cylinder bank are laid out to be substantially mirror-symmetrical with respect to a bank centerline;

the rotational direction of the drive shaft arranged in the first cylinder bank and the rotational direction of the drive shaft arranged in the second cylinder bank are set to be opposite to each other.

15. The internal combustion engine as claimed in claim 1, wherein:

an intake valve of each of the two cylinder banks is arranged to be toward an inside of the cylinder bank, and an exhaust valve of each of the two cylinder banks is arranged to be toward an outside of the cylinder bank;

the rockable cam, which drives the intake valve, is arranged to be toward the inside of the cylinder bank, and the drive shaft is arranged to be toward the outside of the cylinder bank; and the power-transmission mechanism is laid out to extend from the outside of the cylinder bank to the inside of the cylinder bank.

16. The internal combustion engine as claimed in claim 15, further comprising:

a first sprocket and a second sprocket, both rotating in the same rotational direction as the crankshaft;

a first reverse-rotational gear and a second reverse-rotational gear, both in meshed-engagement with each other and rotating in opposite rotational directions;

wherein the first sprocket is fixed to the drive shaft arranged in one of the two cylinder banks, the first reverse-rotational gear is fixed to the second sprocket, and the second reverse-rotational gear is fixed to the drive shaft arranged in the other cylinder bank.

17. A valve operating device for a V-type internal combustion engine equipped with a crankshaft and left and right cylinder banks, each cylinder bank having a cylinder head and a variable valve timing and variable valve lift characteristic mechanism, comprising:

a drive shaft installed in the cylinder head of each cylinder bank and rotating in synchronism with rotation of the crankshaft, the drive shaft having a center and an axis of rotation;

an eccentric cam fixedly connected to the drive shaft so that a center of the eccentric cam is eccentric with respect to the center of the drive shaft;

a rockable cam arranged to drive at least one engine valve;

a power-transmission mechanism mechanically linking the eccentric cam to the rockable cam;

a control mechanism provided for varying an attitude of the power-transmission mechanism; and as viewed in the same axial direction, a lifting direction of the rockable cam arranged in a first one of the left and right cylinder banks relative to a rotational direction of the drive shaft arranged in the first cylinder bank, and a lifting direction of the rockable cam arranged in the second cylinder bank relative to a rotational direction of the drive shaft arranged in the second cylinder bank are set to be identical to each other, the lifting direction being defined as a direction of oscillating motion of the rockable cam from a position that the engine valve begins to lift to a position that the engine valve reaches a maximum valve-lift state in which a magnitude of valve lift of the engine valve is a maximum value.

18. The valve operating device as claimed in claim 17, wherein:

the power-transmission mechanism comprises a first link member fitted to an outer periphery of the eccentric cam so as to be relatively rotatable about the eccentric cam, a rocker arm whose one end is linked to a tip end of the first link member so as to be rotatable relative to the first link member, and a second link member linked to both the other end of the rocker arm and the rockable cam so as to be rotatable relative to both the rocker arm and the rockable cam;

the control mechanism comprises a control shaft extending substantially parallel to the drive shaft and rotated toward and held at an angular position based on engine operating conditions, and a control cam fixedly connected to the control shaft so that a center of the control cam is eccentric with respect to a center of the control shaft; and the rocker arm is fitted to an outer periphery of the control cam so as to be relatively rotatable about the control cam.

19. The valve operating device as claimed in claim 18, wherein:

as viewed in the same axial direction, a rotational direction of the control shaft arranged in the first cylinder bank relative to the rotational direction of the drive shaft arranged in the first cylinder bank, and a rotational direction of the control shaft arranged in the second cylinder bank relative to the rotational direction of the drive shaft arranged in the second cylinder bank are set to be identical to each other.

20. The valve operating device as claimed in claim 17, wherein:

as viewed in the same axial direction and when using a valve stem axis of the engine valve as a reference, the valve operating device arranged in the first cylinder bank and the valve operating device arranged in the second cylinder bank are laid out substantially congruently with each other; and the rotational direction of the drive shaft arranged in the first cylinder bank and the rotational direction of the drive shaft arranged in the second cylinder bank are set to be identical to each other.

21. A valve operating device for a V-type internal combustion engine equipped with a crankshaft and two cylinder banks, each cylinder bank having a cylinder head and a variable valve timing and variable valve lift characteristic mechanism, comprising:

a drive shaft installed in the cylinder head of each cylinder bank and rotating in synchronism with rotation of the crankshaft, the drive shaft having a center and an axis of rotation;

a control shaft extending substantially parallel to the drive shaft and rotated toward and held at an angular position based on engine operating conditions;

a rockable cam fitted to an outer periphery of the drive shaft so as to be relatively rotatable about the drive shaft and to drive at least one intake valve;

an eccentric cam fixedly connected to the drive shaft so that a center of the eccentric cam is eccentric with respect to the center of the drive shaft;

a first link member fitted to an outer periphery of the eccentric cam so as to be relatively rotatable about the eccentric cam;

a control cam fixedly connected to the control shaft so that a center of the control cam is eccentric with respect to a center of the control shaft;

a rocker arm whose one end is linked to a tip end of the first link member so as to be rotatable relative to the first link member, the rocker arm being fitted to an outer periphery of the control cam so as to be relatively rotatable about the control cam;

a second link member linked to both the other end of the rocker arm and the rockable cam so as to be rotatable relative to both the rocker arm and the rockable cam;

as viewed in the same axial direction and when using a valve stem axis of the intake valve as a reference, the valve operating device arranged in the first cylinder bank and the valve operating device arranged in the second cylinder bank are laid out substantially congruently with each other; and the rotational direction of the drive shaft arranged in the first cylinder bank and the rotational direction of the drive shaft arranged in the second cylinder bank are set to be identical to each other.

22. The valve operating device as claimed in claim 21, wherein:

a straight line through the center of the drive shaft arranged in the first cylinder bank and a center of the control shaft arranged in the first cylinder bank is set to a predetermined position that the straight line is rotated about the drive shaft arranged in the first cylinder bank in a rotational direction by an angle with respect to the valve stem axis of the intake valve arranged in the first cylinder bank; and a straight line through the center of the drive shaft arranged in the second cylinder bank and a center of the control shaft arranged in the second cylinder bank is set to a predetermined position that the straight line is rotated about the drive shaft arranged in the second cylinder bank in the same rotational direction by the same angle with respect to the valve stem axis of the intake valve arranged in the second cylinder bank.

23. The valve operating device as claimed in claim 21, wherein:

a distance between the center of the drive shaft arranged in the first cylinder bank and a center of the control shaft arranged in the first cylinder bank and a distance between the center of the drive shaft arranged in the second cylinder bank and a center of the control shaft arranged in the second cylinder bank are set to be identical to each other;

a distance between the center of the drive shaft arranged in the first cylinder bank and a center of a connecting portion between the rockable cam and the second link member both arranged in the first cylinder bank and conditioned in a maximum valve-lift state in which a magnitude of valve lift of the intake valve is a maximum value, and a distance between the center of the drive shaft arranged in the second cylinder bank and a center of a connecting portion between the rockable cam and the second link member both arranged in the second cylinder bank and conditioned in the maximum valve-lift state are set to be identical to each other;

as compared to the first cylinder bank, the center of the control shaft arranged in the second cylinder bank is set to a predetermined position that the center of the control shaft arranged in the second cylinder bank is rotated about the drive shaft arranged in the second cylinder bank in a predetermined rotational direction by a predetermined angle $\alpha 2$ with respect to the valve stem axis of the intake valve arranged in the second cylinder bank; and as compared to the first cylinder bank, the center of the connecting portion arranged in the second cylinder bank is set to a predetermined position that the center of the connecting portion arranged in the second cylinder bank is rotated about the drive shaft arranged in the second cylinder bank in the same predetermined rotational direction as the center of the control shaft arranged in the second cylinder bank by the same predetermined angle $\alpha 2$ as the center of the control shaft arranged in the second cylinder bank with respect to a line segment between and including a center of oscillating motion and a valve-lift starting point of the rockable cam arranged in the second cylinder bank.

24. The valve operating device as claimed in claim 21, wherein:

in each of the two cylinder banks, a center of a connecting portion between the rockable cam and the second link member conditioned in a maximum valve-lift state in which a magnitude of valve lift of the intake valve is a maximum value, is laid out to lie on a prolongation of the straight line through the center of the drive shaft and a center of the control shaft.

25. The valve operating device as claimed in claim 21, wherein:

in each bank of the two cylinder banks, the center of the drive shaft and a center of the control shaft are aligned with the valve stem axis of the intake valve.

26. The valve operating device as claimed in claim 23, wherein:

the center of the control shaft arranged in the first cylinder bank is set to a predetermined position that the center of the control shaft arranged in the first cylinder bank is rotated about the drive shaft arranged in the first cylinder bank in a predetermined rotational direction by a predetermined angle $\beta 1$ with respect to the valve stem axis of the intake valve arranged in the first cylinder bank; and the center of the control shaft arranged in the second cylinder bank is set to a predetermined position that the center of the control shaft arranged in the second cylinder bank is rotated about the drive shaft arranged in the second cylinder bank in a rotational direction opposite to the predetermined rotational direction of the control shaft arranged in the first cylinder bank by the same predetermined angle $\beta 1$ as the center of the control shaft arranged in the first cylinder bank with respect to the valve stem axis of the intake valve arranged in the second cylinder bank.

27. The valve operating device as claimed in claim 21, wherein:

in at least one of the two cylinder banks, as viewed in an axial direction, a center of a connecting portion between the rockable cam and the second link member both conditioned in the maximum valve-lift state are laid out in a reverse side of a center of the control shaft with respect to the valve stem axis of the intake valve.

28. The valve operating device as claimed in claim 21, wherein:

in at least one of the two cylinder banks, the center of the control shaft is laid out to be toward a center of the cylinder head with respect to the valve stem axis of the intake valve.

29. The valve operating device as claimed in claim 28, wherein:

the valve operating device of the V-type internal combustion engine with the crankshaft and the left and right cylinder banks comprises an intake valve operating device of a V-type transverse internal combustion engine;

the center of the control shaft arranged in a front cylinder bank of the two cylinder banks is laid out to be toward the center of the cylinder head with respect to the valve stem axis of the intake valve.

30. The valve operating device as claimed in claim 17, wherein:

as viewed in the same axial direction, the valve operating device arranged in the first cylinder bank and the valve operating device arranged in the second cylinder bank are laid out to be substantially mirror-symmetrical with respect to a bank centerline;

the rotational direction of the drive shaft arranged in the first cylinder bank and the rotational direction of the drive shaft arranged in the second cylinder bank are set to be opposite to each other.

31. The valve operating device as claimed in claim 17, wherein:

an intake valve of each of the two cylinder banks is arranged to be toward an inside of the cylinder bank, and an exhaust valve of each of the two cylinder banks is arranged to be toward an outside of the cylinder bank;

the rockable cam, which drives the intake valve, is arranged to be toward the inside of the cylinder bank, and the drive shaft is arranged to be toward the outside of the cylinder bank; and the power-transmission mechanism is laid out to extend from the outside of the cylinder bank to the inside of the cylinder bank.

32. The valve operating device as claimed in claim 31, further comprising:

a first sprocket and a second sprocket, both rotating in the same rotational direction as the crankshaft;

a first reverse-rotational gear and a second reverse-rotational gear, both in meshed-engagement with each other and rotating in opposite rotational directions;

wherein the first sprocket is fixed to the drive shaft arranged in one of the left and right cylinder banks, the first reverse-rotational gear is fixed to the second sprocket, and the second reverse-rotational gear is fixed to the drive shaft arranged in the other cylinder bank.

33. The valve operating device as claimed in claim 32, wherein:

the drive shaft has a rotary cam and also serves as a camshaft for the exhaust valve for opening and closing the exhaust valve.

* * * * *